United States Patent [19]

Caruthers

[11] Patent Number: 5,009,416

[45] Date of Patent: Apr. 23, 1991

[54] GRIP FACILITATING HANDLE

[75] Inventor: Scott Caruthers, Glen Burnie, Md.

[73] Assignee: DAR Products Corporation, Baltimore, Md.

[21] Appl. No.: 325,915

[22] Filed: Mar. 20, 1989

Related U.S. Application Data

[63] Continuation-in-part of Ser. No. 241,297, Sep. 9, 1988, Pat. No. 4,896,880, which is a continuation-in-part of Ser. No. 94,794, Sep. 14, 1987, Pat. No. 4,813,669.

[51] Int. Cl.[5] ..... A63B 21/00

[52] U.S. Cl. ..... 272/143; 272/68; 272/122; 294/25

[58] Field of Search ..... 272/67, 68, 117, 119, 272/122, 123, 143; 2/160, 161 R, 161 A; 294/25, 26

[56] References Cited

U.S. PATENT DOCUMENTS

| | | | |
|---|---|---|---|
| 4,029,312 | 6/1977 | Wright | 272/123 |
| 4,487,412 | 12/1984 | Meeko | 272/1232 |
| 4,546,495 | 10/1985 | Castillo | 272/119 X |
| 4,570,269 | 2/1986 | Berlese | 2/161 A |
| 4,627,618 | 12/1986 | Schwartz | 272/122 |
| 4,695,051 | 9/1987 | Jenison | 272/122 |
| 4,698,850 | 10/1987 | Patton, Sr. et al. | 2/161 A X |
| 4,793,005 | 12/1988 | Hetzel, Jr. | 2/161 A |
| 4,796,306 | 1/1989 | Mitchell | 2/160 |
| 4,813,669 | 3/1989 | Caruthers | 272/122 |
| 4,827,535 | 5/1989 | Socey | 2/161 A |

*Primary Examiner*—Robert Bahr

*Attorney, Agent, or Firm*—Leonard Bloom

[57] ABSTRACT

A handle is applicable to a wide variety of apparatuses, equipment and devices found in industry, commerce, in the home, or for exercise or recreational purposes. The handle may be fashioned integrally with the apparatus or as a retrofit attachment therefor. In using the handle, the person's hand is inserted through an opening and into a chamber formed between the inner and outer walls of the handle. The palm of the person's hand substantially rests on the convex inner surface of an inner wall of the handle, while the back of the person's hand substantially confronts the concave inner surface of the outer wall. With this arrangement, the user's hand is maintained substantially in a curved natural "at rest" position, rather than being tightly closed, so that a forceful grip is no longer necessary. As a result, the human effort and energy required to manipulate or control the associated apparatus, equipment or device is substantially reduced, thereby substantially reducing the fatigue normally associated therewith. Moreover, in certain applications (such as portable power tools) the handles provide an enhanced safety feature.

18 Claims, 32 Drawing Sheets

GRIP FACILITATING HANDLE

CROSS REFERENCE TO RELATED APPLICATIONS

The present application constitutes a continuation-in-part of pending application Ser. No. 241,297 filed on Sept. 9, 1988, now U.S. Pat. No. 4,896,880, which in turn is a continuation-in-part of pending application Ser. No. 094,794 filed Sept. 14, 1987, now U.S. Pat. No. 4,813,669; and the respective disclosures of these pending applications are incorporated by reference herein in their entireties.

FIELD OF THE INVENTION

The present invention relates to handles for a variety of apparatuses, such as exercise devices, barbells, and stationary exercise machines and equipment, as well as hand tools, portable power tools, stationary power tools, earth-moving equipment, motorcycles, devices for assisting handicapped and temporarily disabled persons, etc.

BACKGROUND OF THE INVENTION

In the aforesaid applications, Ser. Nos. 094,794 and 241,297, respectively, there was disclosed and claimed an improved exercise device for strengthening the targeted muscle of a user; the exercise device had a weight means associated therewith, such that a forceful grip of the user's hand on the weight means was not necessary, and such that the necessity for employing the user's conjunctive adjoining muscles was substantially reduced, thereby substantially reducing the tendency to detract from the development of the user's targeted muscle.

In the prior art exercise devices, the gripping and grasping action with the hand automatically employed the conjunctive muscles of the arm, including the forearm, tricep and deltoid; and the same problem was encountered for the exercise and strengthening of other muscles in the body. Unfortunately, each of the apparatuses and devices resorted to in the prior art for developing a specifically targeted muscle (such as the bicep) provided for some sort of handle which had to be gripped and/or grasped by the user thereof. This gripping and/or grasping action required by each of these devices was a definite disadvantage, since it involved the use of conjunctive muscles which prevented the isolation required for the total development of the targeted muscle.

More specifically, every piece of exercise equipment or mechanical apparatus heretofore resorted to in the prior art invariably contained one common detractive denominator inherent within its design. Whatever else was intended—whether barbell, dumbbell, or one of the various exercise machines designed for total fitness—there existed some sort of handle which had to be grasped in order to use the device. Quite clearly, one was required to hold onto the handle to make the device work. This action of holding the handle automatically and necessarily employed the conjunctive (adjoining) muscles. Such "helper" muscles actually took away from the isolation required for full development of any specifically targeted muscle.

This detractive denominator occurred because of the physiological structure of the human body. A precise interface of cardiovascular, neural-nervous system, respiratory, and muscular function was adequate to carry the average person through their normal daily activity. However, this interface was simply not sufficient to create an above average (or dynamic) physique. Combined with the time constraints that typically discourage regular exercise, the obvious result was a rather large population group composed of "ordinary" (somewhat less than splendidly developed) individuals.

Thus, it will be appreciated that there remained a need for an exercise device for strengthening a user's targeted muscle; wherein the device was capable of being utilized by the user, such that a forceful grip was not required by the user; and wherein the necessity for employing the user's conjunctive adjoining muscles was substantially reduced, thereby substantially reducing the tendency to detract from the development of the user's targeted muscle. The aforesaid pending applications (Ser. Nos. 094,794 and 241,297) eliminated this serious disadvantage and deficiency of the prior art exercise devices.

Moreover, similar problems have been encountered in the handles employed in a variety of apparatuses, such as stationary exercise machines, as well as hand tools, portable power tools, stationary power tools, earth-moving equipment, motorcycles, devices for assisting handicapped or temporarily disabled persons, and, indeed, any apparatus having a handle which normally requires a forceful grip to be employed on the handle in the manipulation or control of the apparatus. In these apparatuses, the force required to grip the handle naturally contributes to the fatigue normally associated with the use and operation of the particular apparatus.

SUMMARY OF THE INVENTION

Accordingly, it is an object of the present invention to alleviate the deficiencies and disadvantages of the prior art by providing a handle for an apparatus, wherein the user's hand is substantially in a curved natural "at rest" position within the handle rather than being tightly closed around the handle, such that a forceful grip is not required, thereby substantially reducing the effort required to manipulate or control the apparatus, and thereby substantially reducing the fatigue normally associated therewith.

It is another object of the present invention to provide a handle for an apparatus which is either integrally assembled with the apparatus or else is provided as a removable retrofit attachment for an existing handle of the apparatus.

In carrying out the objects of the present invention, one embodiment thereof constitutes an exercise device for strengthening a user's targeted muscle which is capable of being utilized by the user thereof, such that the necessity for employing the user's conjunctive adjoining muscles is substantially reduced, thereby substantially reducing the tendency to detract from the development of the user's targeted muscle.

The present invention also provides a handle (or handles) for a stationary exercise machine wherein a forceful grip is not required on the handle (or handles) thereby substantially improving the development of the user's targeted muscle (or muscles) using the stationary exercise machine.

In accordance with the teachings of the present invention, there is herein disclosed and claimed, a handle for the manipulation or control of the apparatus, wherein the handle does not require a forceful grip for the manipulation or control of the apparatus. The handle is substantially unitary and has respective inner and outer walls defining a chamber therebetween. The handle has an opening formed therein and communicating with the chamber for providing access for the user's hand, such that the user's hand is disposed in the chamber between the inner and outer walls of the handle. The inner wall has a convex inner surface, and the outer wall having a concave inner surface, such that the palm of the user's hand substantially rests on the convex inner surface of the inner wall, and such that the back of the user's hand substantially confronts the concave inner surface of the outer wall. With this arrangement, the user's hand is substantially in a curved natural at rest position rather than being tightly closed, thereby substantially reducing the effort required to manipulate or control the apparatus, and thereby substantially reducing the fatigue normally associated therewith.

Preferably, the outer wall further has a convex outer surface; the inner and outer walls are joined together at an outer extremity of the handle, and the chamber gradually narrows in height between the inner and outer walls of the handle in the direction from the opening in the handle to the outer extremity thereof. For certain applications, the outer wall may be provided with a plurality of ventilation openings.

In the preferred embodiment, the convex inner surface of the inner wall, and the concave inner surface of the outer wall, are each provided with a padding or cushioned layer. The cushioned layer may be continuous and have a substantially uniform cross-section, if desired.

Preferably, the handle further has a pair of substantially parallel side walls joining the inner and outer walls; and each of the side walls is provided with an indentation, such that the user's thumb may rest in an indentation of a respective side wall, and such that the pair of indentations in the respective side walls facilitate use of the handle by either right-handed or left-handed users. In certain applications, each indentation may be provided with a protective shroud for improved safety considerations.

In the preferred embodiment, the inner wall further has a continuation thereof extending past the opening in the handle and including a substantially concave portion, such that the heel of the user's hand adjacent to the palm thereof may rest against the concave portion of the continuation of the inner wall.

The handle may be integrally formed with its associated apparatus or device; and, alternately, the handle comprises a retrofit attachment to an existing handle of the apparatus, together with means for removably securing the attachment to the existing handle of the apparatus.

Preferably, the means for removably securing the attachment to the existing handle of the apparatus comprises a C-clamp secured to the inner wall of the attachment and projecting away from the attachment. The C-clamp has a convex surface which is substantially nested within the concave inner surface of the inner wall of the attachment. The C-clamp further has a pair of legs straddling the handle of the apparatus, and means are provided for tightening the legs of the C-clamp on to the handle.

Preferably, a longitudinal key is formed on the inner wall of the attachment, and the existing handle is provided with a plurality of circumferentially-spaced longitudinally-splined keyways for cooperation with the longitudinal key on the attachment, such that the attachment may be secured on the existing handle in a selected circumferentially-adjusted position.

In one embodiment, the convex inner surface of the inner wall is formed on an arc, the center of which is substantially coincident with the longitudinal center of the existing handle. However, the convex outer surface of the outer wall is formed on an arc which is eccentrically disposed with respect to the longitudinal center of the existing handle.

Viewed in another aspect, the present invention provides a retrofit handle for attachment to the existing handle of an apparatus or device, wherein the existing handle generally has a longitudinal center line. The retrofit handle has a chamber formed therein and further has an opening communicating with the chamber and providing access for the user's hand, such that the user's hand is disposed substantially within the chamber. The chamber has a height measured in a direction which is substantially transversely of the chamber; and the height of the chamber is reduced in a direction inwardly of the chamber, such that the user's hand is substantially in a natural curved at rest position rather than being tightly closed around the existing handle, thereby substantially reducing the human effort and energy required to manipulate or control the apparatus or device. Means are provided for removably securing the retrofit handle to the existing handle in a selected circumferentially-adjusted position relative to the center line of the existing handle, such that the retrofit handle may be utilized in an optimum position for the particular person, the respective apparatus, and its mode of operation.

Thus it will be appreciated by those skilled in the art that the teachings of the present invention are equally applicable to a wide variety of apparatuses, equipment and devices, including the following: exercise devices, such as dumbbells and barbells; stationary exercise machines, such as weight training machines, exercise bicycles and the like; stationary horizontal bars on which exercises or gymnastics are performed; devices for assisting handicapped or temporarily disabled persons; portable power tools, such as a chain saw; hand tools, such as a hand plane; stationary power tools, such as a drill press; earth-moving equipment, such as a bulldozer; motorcycles; etc.

These and other objects of the present invention will become apparent from a reading of the following specification, taken in conjunction with the enclosed drawings.

BRIEF DESCRIPTION OF THE DRAWINGS

FIG. 12 is a side elevation of the body portion of the casing for the weight means, wherein the body portion is folded into a substantially flat shape for shipment.

FIG. 13 is an end view of the body portion of FIG. 12.

FIG. 14 is a side elevation of the body portion of the casing, wherein the body portion is unfolded into a substantially cylindrical shape for use thereof during manufacture of the exercise device.

FIG. 15 is an end view of the unfolded cylindrical body portion, corresponding substantially to FIG. 14.

FIG. 16 is a perspective view of the cylindrical body portion with a cap inserted on one end thereof and further with weights being disposed therein.

FIG. 17 is a further perspective view of the cylindrical body portion having all the weights disposed therein, further showing the insertion of a cap on the other end thereof.

FIG. 18 is a perspective view of the cylindrical weight means being disposed in the respective concave inner recess of one of the hemispherical housing portions.

FIG. 19 is another perspective view of the other of the hemispherical housing portions, shown partially disposed over the other of the opposed ends of the cylindrical weight means.

FIG. 20 is still another perspective view, showing the hemispherical housing portions being assembled and almost completely covering the cylindrical weight means.

DESCRIPTION OF THE PREFERRED EMBODIMENTS

The Hand-Held Exercise Devices

Figure 1:
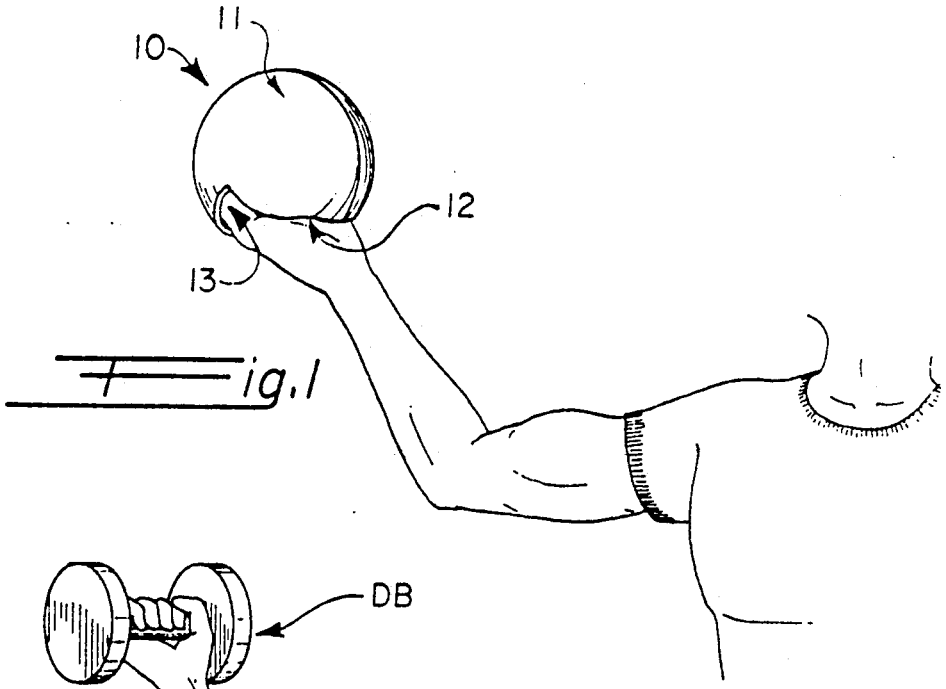
FIG. 1 is a pictorial view of an improved exercise device utilizing the teachings of the present invention, illustrating one use of the device for strengthening the user's targeted muscle which, in this case, is the bicep.

With reference to FIG. 1, there is illustrated the exercise device 10 of the present invention for strengthening one of the user's targeted muscles (in this case, the bicep) such that a forceful grip is not required by the user. Such an arrangement substantially eliminates the necessity for employing the user's conjunctive muscles adjoining the bicep. In this manner, the tendency to detract from the development of the user's targeted bicep muscle is substantially reduced.

Figure 1A:
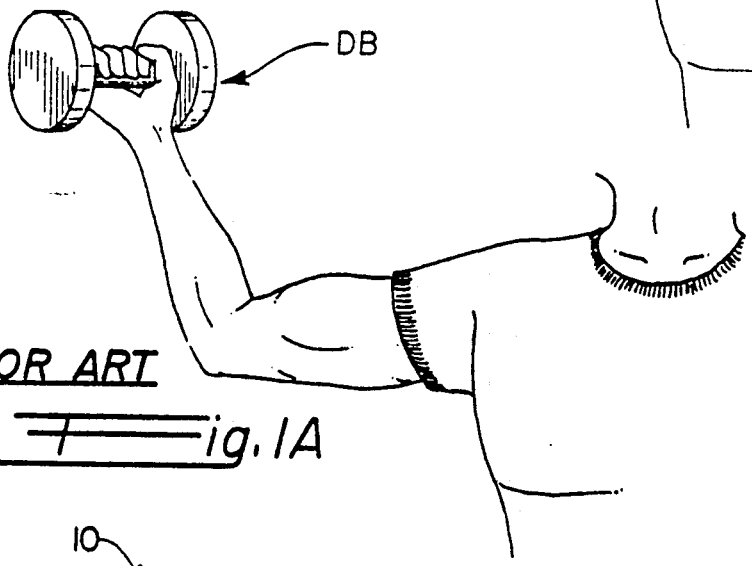
PRIOR ART Fig. 1A
FIG. 1A is a pictorial view of a conventional prior art dumbbell, illustrating its normal use.

By comparison, and with reference to FIG. 1A, there is illustrated the use of a conventional dumbbell DB for strengthening the user's targeted muscle (again, in this case, the bicep). In using these conventional devices, such as a dumbbell, the user must forcefully grip the handle of the dumbbell. This gripping action has the tendency to detract from the development of the user's targeted bicep muscle, thereby substantially reducing the efficiency of the device.

The same concept is equally applicable to other targeted muscles, besides the bicep, consonant with the teachings of the present invention.

Figure 2:
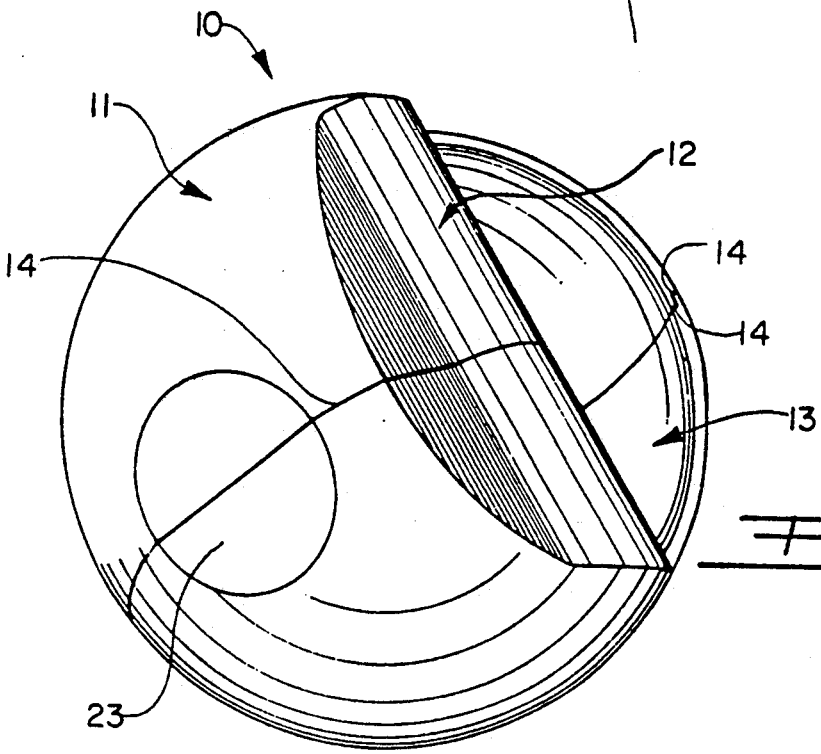
FIG. 2 is a perspective view of a preferred embodiment of the exercise device of the present invention.
Figure 3:
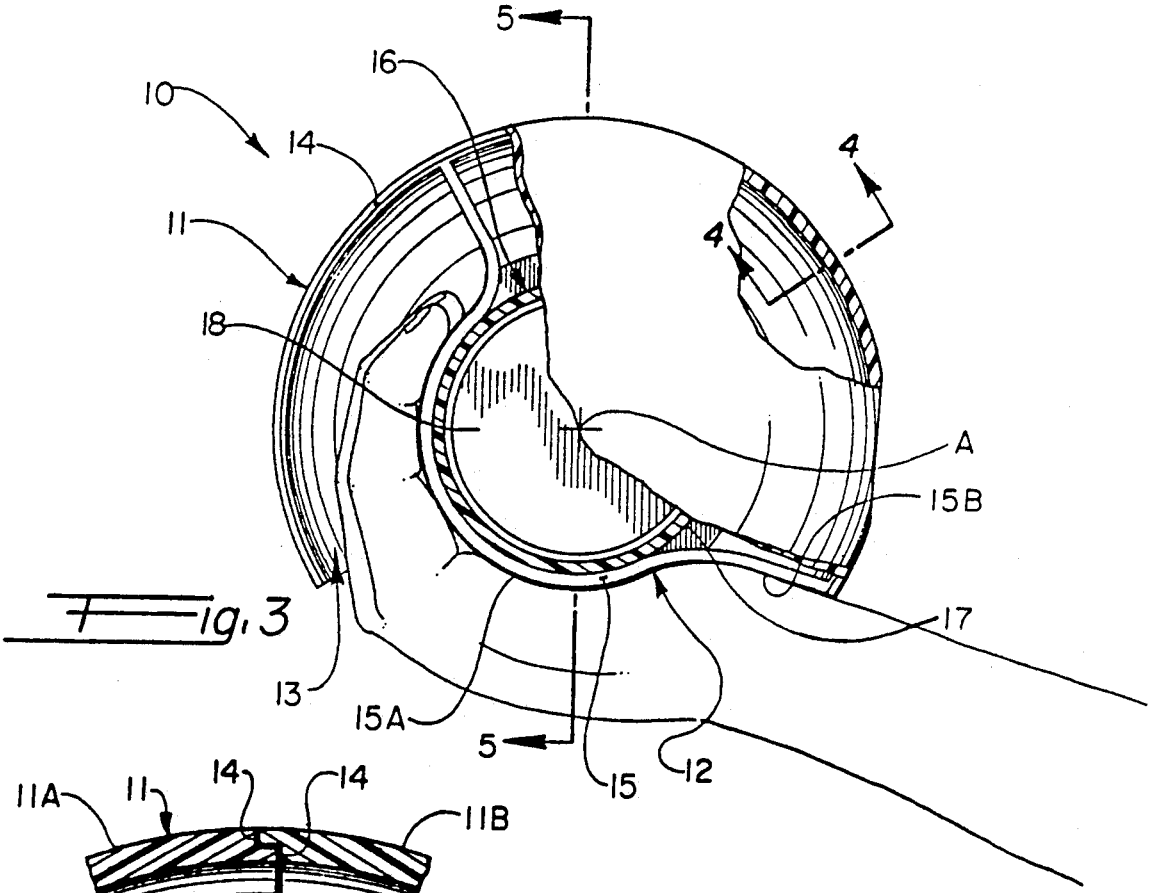
FIG. 3 is a side elevational view of the exercise device, with parts thereof broken away and sectioned, to show the positioning of the user's hand therein between the relatively thin-walled housing and the cylindrical weight means mounted in the housing.
Figure 4:
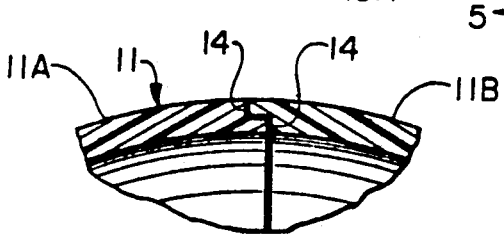
FIG. 4 is a section view, taken along lines 4—4 of FIG. 3 and drawn to an enlarged scale, and showing the arcuate ribs between the complementary relatively thin-walled hemispherical housing portions.
Figure 5:
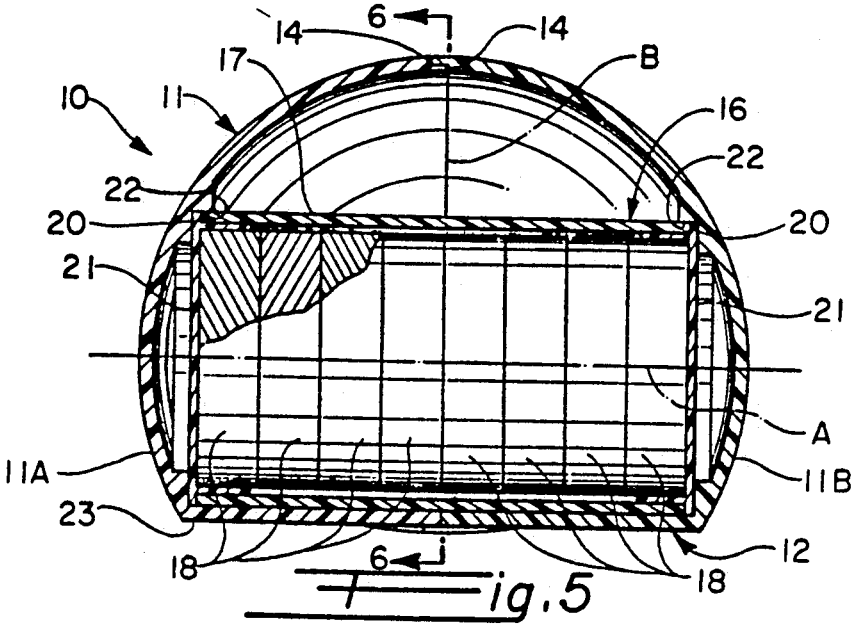
FIG. 5 is a section view, taken along lines 5—5 of FIG. 2, and showing the manner in which the cylindrical weight means is mounted between the complementary housing portions.
Figure 7:
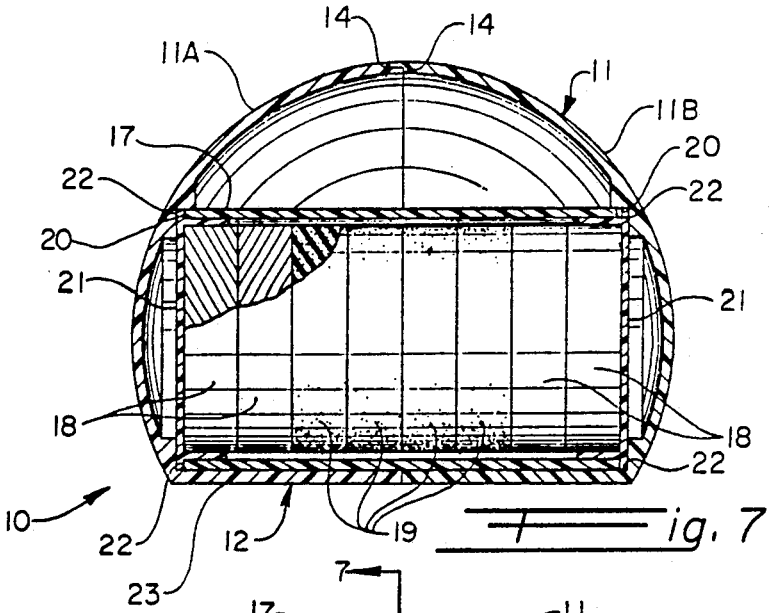
FIG. 7 is another section view, corresponding substantially to FIG. 5, but showing several "filler" or "dummy" weights disposed in the cylinder.
Figure 6:
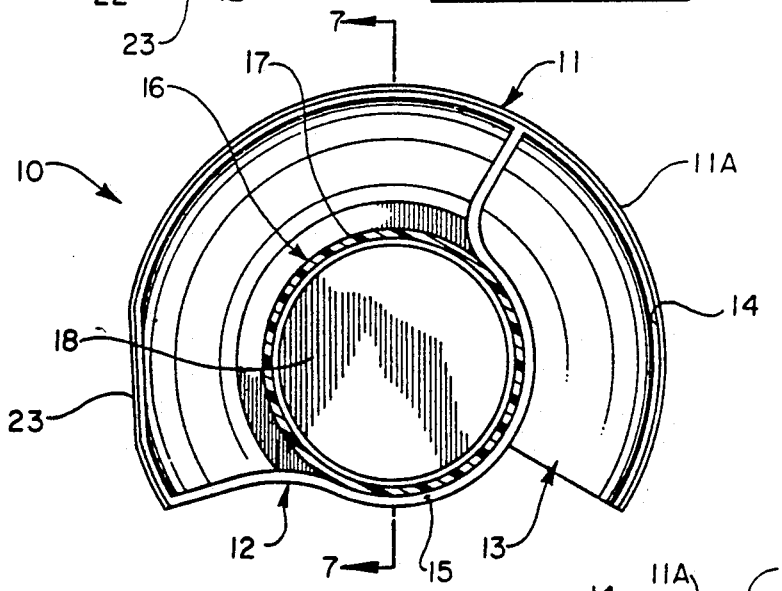
FIG. 6 is a section view, taken along lines 6—6 of FIG. 5.
Figure 8:
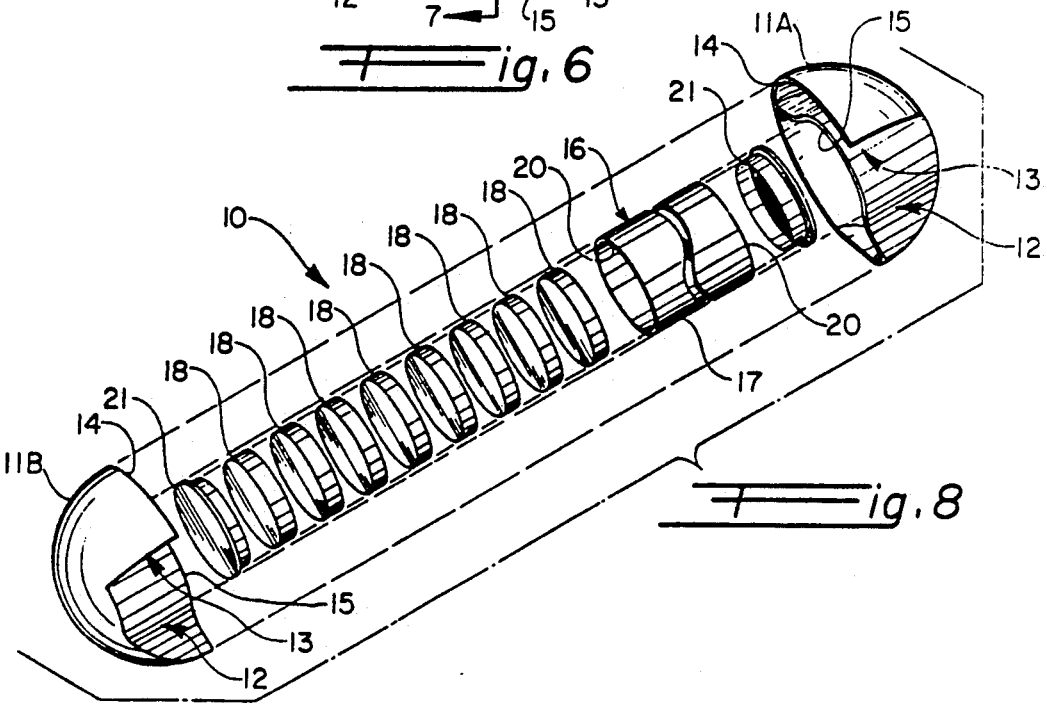
FIG. 8 is an exploded perspective view of the exercise device of FIG. 5.

With reference to FIGS. 2–4, the exercise device 10 includes a substantially-spherical relatively thin-walled housing 11 having a diametral axis designated at A. The housing 11 includes a pair of housing portions 11A and 11B joining at a common midplane B. Each of the housing portions 11A and 11B is preferably substantially hemispherical and identical to one another; moreover, the housing halves 11A and 11B are molded from a suitable plastic material, such as a polycarbonate having relatively high impact strength. However, it will be expressly understood and appreciated by those skilled in the art that the present invention is not so limited.

With this in mind, the housing 11 has a cut-away portion 12 formed therein. The housing further has an opening 13 formed therein substantially tangentially of the housing 11 and communicating with the cut-away portion 12. Through this opening 13, and as shown more clearly in FIG. 3, the hand of the user may be inserted into the housing 11 for use of the exercise device 10.

The housing 11 includes a suitable keying means between the pair of hemispherical portions 11A and 11B, whereby the hemispherical portions are retained together and form the substantially spherical housing 11. Preferably, and as shown more clearly in FIG. 4, this keying means includes an arcuate rib 14 formed on the peripheral edges of each of the housing portions 11A and 11B. These ribs 14 are complementary and are mated when the housing portions 11A and 11B are brought together to form the spherical housing 11. Thereafter, the edges of the housing portions 11A and 11B are glued, ultrasonically welded, or otherwise integrally joined with one another.

Each of the thin-walled housing portions 11A and 11B has a concave inner walled portion 15 forming a circular recess (for purposes hereinafter described).

With further reference to FIGS. 5–8, the weight means comprises a casing 16 disposed within the housing 11 and, preferably, substantially coincident with the diametral axis A of the housing 11 and at right angles to the common midplane B between the housing portions 11A and 11B. The casing 16 has a body portion 17, within which disc-shaped weights 18 and/or "dummy" weights or "fillers" 19 are disposed. Preferably, the casing 16 is substantially cylindrical in shape. However, it is to be understood that any suitable shape of the casing 16 may be employed (and other types of ballast may be employed other than the fillers 19) consonant with the teachings of the present invention. The body portion 17 of the casing 16 further has a pair of opposed ends 20, each of which is preferably open.

A cap 21 is disposed over each open end 20 of the casing 16. The caps 21 aid in retaining the selected weights 18 and/or "fillers" 19 within the casing 16. If desired, the caps 21 may be omitted entirely, with either (or both) opposed end portions 20 being integrally sealed with a respective end wall, or with both ends 20 being left open.

Disposed in the casing 16 is the selected weights 18 and/or "fillers" 19 which are desired to be lifted by the targeted muscle. It is preferred that each weight 18 be shaped substantially coincident with the shape of the interior of the casing 16, and particularly the body portion 17 thereof. If, as in the preferred embodiment, the casing is substantially cylindrical in shape, then each weight 18 and/or "filler" 19, is preferably substantially disc-shaped in appearance and is sized to be received within the body portion 17 of the casing 16. The weights 18 may be fabricated from lead, steel, sand enclosed in plastic, or any other suitable material.

The "dummy" weights or "fillers" 19 may be utilized in place of any one or several of the weights 18. Such "fillers" 19 are preferably fabricated from a foam plastic (or other suitable) material having substantially identical geometric proportions as the weights 18 themselves. By substituting any one or several "fillers" 19 for the "real" weights 18, the weight of the device 10 being lifted by the targeted muscle (the bicep, for example) may vary from substantially zero (wherein all "fillers" 19 and no weights 18 are utilized) to a maximum value (wherein all weights 18 and no "fillers" 19 are utilized).

It is to be understood that any suitable weight or weights may be employed consonant with the teachings of the present invention. In a preferred embodiment, each of the weights 18 weighs 1.25 pounds. If the casing 16 is sized so as to receive eight (8) such 1.25 pound weights 18 therein, then no "fillers" 19 are employed, and basically, a ten (10) pound weight is obtained for the exercise device; and if only four (4) of the weights 18 are employed, then basically, a five (5) pound weight is obtained, in which case four (4) fillers 19 are employed as shown more clearly in FIG. 7. In a preferred embodiment, the complementary hemispherical housing halves 11A and 11B, together, weigh ten ounces (10 oz.) and, if desired, this weight may be taken into account in determining the weight of the overall exercise device 10. Moreover, if desired, a heavier weight may be chosen for the housing halves 11A and 11B.

While it is not necessary that such "fillers" 19 be utilized, the use of such "fillers" 19 aids in filling the interior of the casing 16, thereby preventing the weights 18 disposed therein from shifting during the use thereof. If such "fillers" 19 were not provided, then the weights 18 disposed therein may be subject to lateral movements (or "shifting") within the casing 16 during use of the device 10.

As noted herein, each of the hemispherical housing portions 11A and 11B of the relatively thin-walled housing 11 is provided with a concave inner walled portion 15. Each of these concave inner portions 15 receives and supports a respective opposed end 20 of the casing 16 therein, when the hemispherical housing portions 11A and 11B are joined to one another. Preferably, each of the opposed ends 20 is further supported on a respective internal annular shoulder 22 formed in each of the concave inner portions 15.

With reference again to FIG. 3, during use of the exercise device 10 of the present invention to strengthen the user's bicep (for example), the hand of the user is inserted through the opening 13 in the housing 11 and at least partially around the casing 16 radially thereof. In this manner, the user's hand is "cradled" in the hollow spherical housing 11, being at least partially disposed between the casing 16 and the relatively-thin wall of the housing 11. The palm of the user's hand is supported substantially against the convexly-formed inner walled portion 15A, such that the heel of the user's hand is supported substantially on the concave section 15B of the inner walled portion 15.

When utilized in this fashion, the user's hand at all times remains in a comfortable, natural "at rest" position. In such a manner, a forceful grip by the user is not required throughout the full range of motion of the exercise device 10, such that the necessity for employing the user's muscles which adjoin the bicep (the conjunctive muscles) is substantially reduced. As a result, the device 10 substantially reduces the tendency to detract from the development of the user's targeted muscle (in this case, for example, the bicep).

Figure 9:
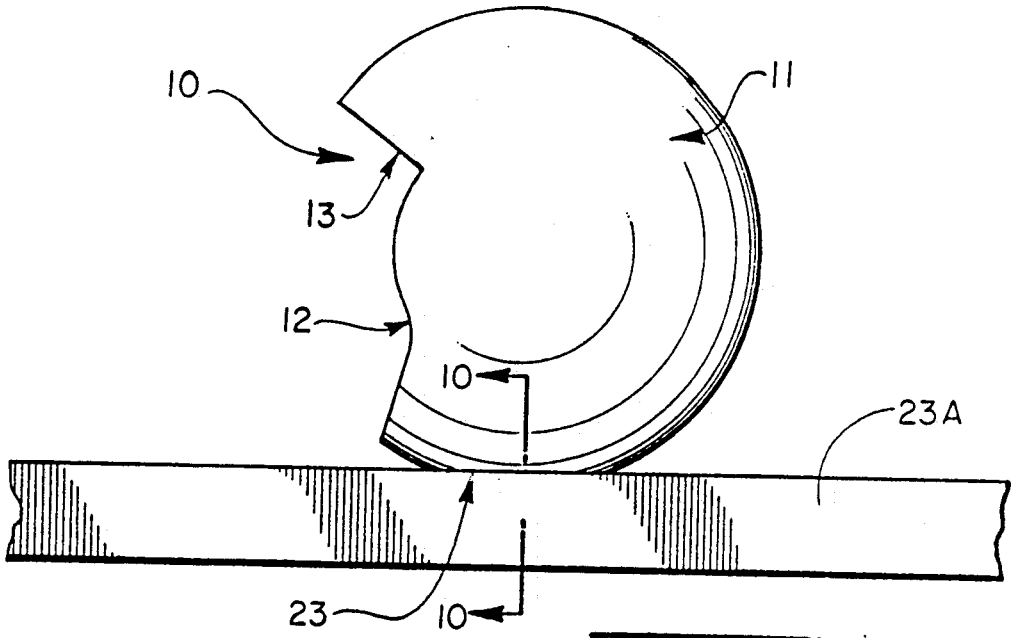
FIG. 9 shows the positioning of the exercise device of the present invention upon a table (or other surface) so that the exercise device will not roll off the table.
Figure 10:
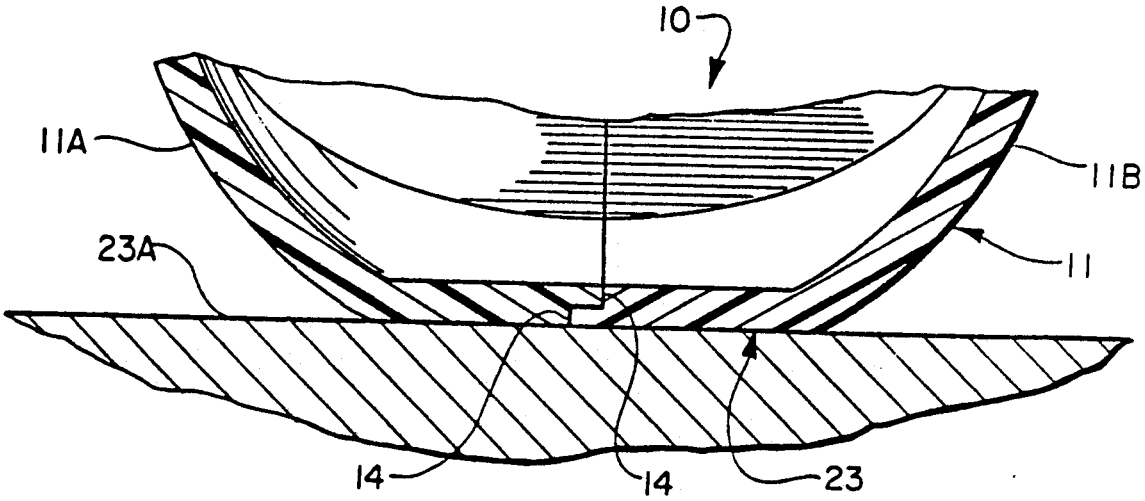
FIG. 10 is a section view thereof, taken along lines 10—10 of FIG. 9, and drawn to an enlarged scale.

With reference to FIGS. 9 and 10, the outer surface of the housing 11 may, if desired, be truncated to form a flat surface 23 thereon. Provision of this flat surface 23 aids in preventing the device from rolling when the exercise device 10 is placed on a substantially flat surface, such as a table 23A as illustrated in FIGS. 9 and 10.

Figure 11:
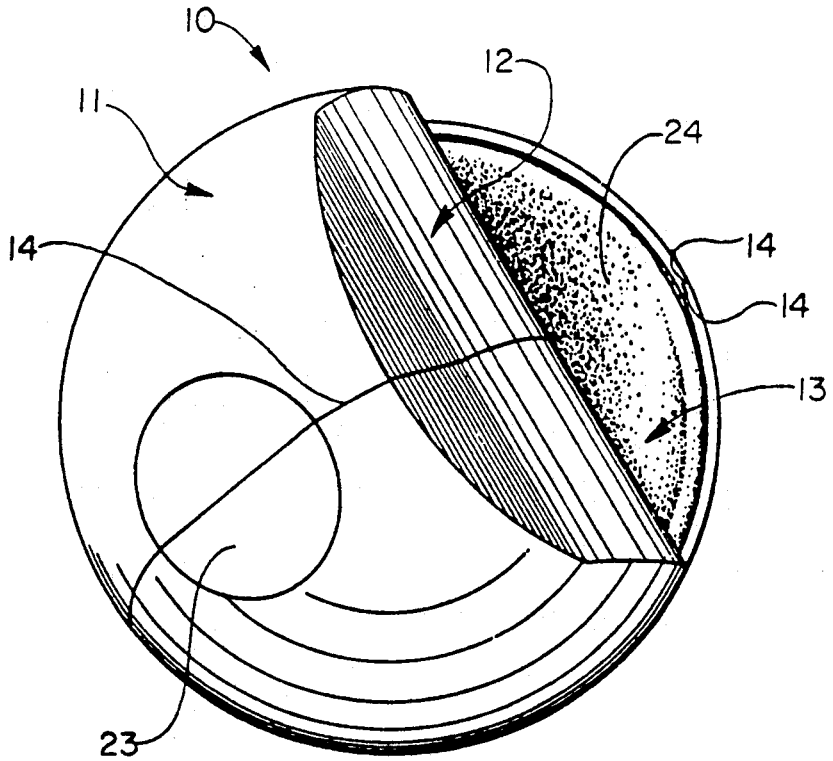
FIG. 11 is another perspective view of the exercise device of the present invention, showing the padding disposed within the housing for providing a cushion for the hand of the user during use of the device.
Figure 12:
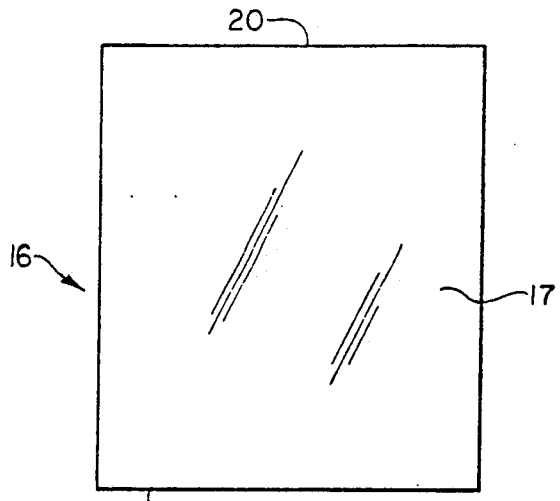
FIGS. 12-20 are sequence views, illustrating the method for forming and assembling a preferred embodiment of the exercise device of the present invention.
Figure 14:
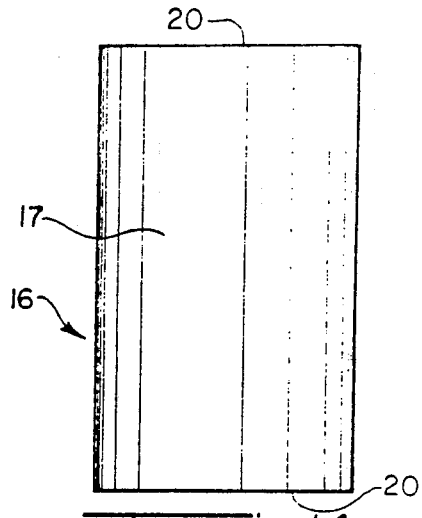
Figure 13:
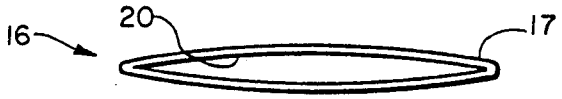
Figure 15:
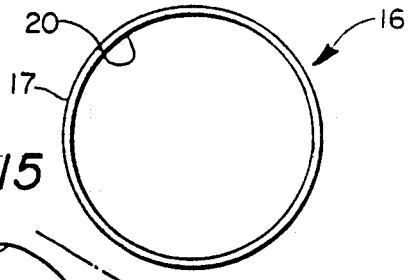

With reference to FIG. 11, in a preferred embodiment of the exercise device 10, a padding 24 (or other suitable means) may be disposed within the housing 11 and between the casing 16 and the housing 11. In this manner, a cushion is provided for the hand of the user which is disposed in the exercise device 10 during use thereof. Additional padding may be disposed within the housing 11, opposite to the padding 24, if desired.

With reference to FIGS. 12–20, there is illustrated the sequence of steps comprising the preferred method for assembling and forming the exercise device 10 of the present invention.

Preferably, each of the hemispherical housing portions 11A and 11B is molded from a relatively high-impact strength polycarbonate or other plastic or suitable material; and, as previously described, the hemispherical housing portions 11A and 11B are formed as mirror images of each other. If desired, the casing 16 may be molded as a sleeve or tubing or else extruded; but in the preferred embodiment, the body portion 17 of the casing 16 comprises a flexible plastic sleeve which is folded flat for shipment (as shown more clearly in FIGS. 12 and 13) and then is unfolded (as shows more clearly in FIGS. 14 and 15) into a substantially cylindrical shape for use in the fabrication and assembly of the overall exercise device 10. The cylindrical body portion 17 is sold under the trademark "JETRAN" by SLM Manufacturing Corp. (of Somerset, N.J.). Caps 21 are formed for each respective open end of the cylindrical body portion 17.

Figure 16:
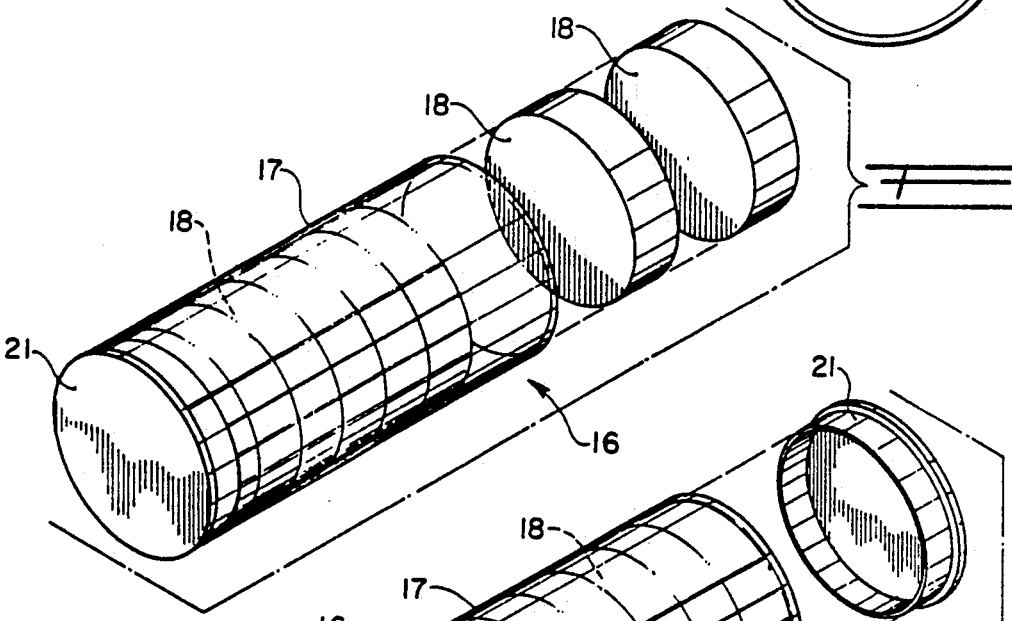
Figure 17:
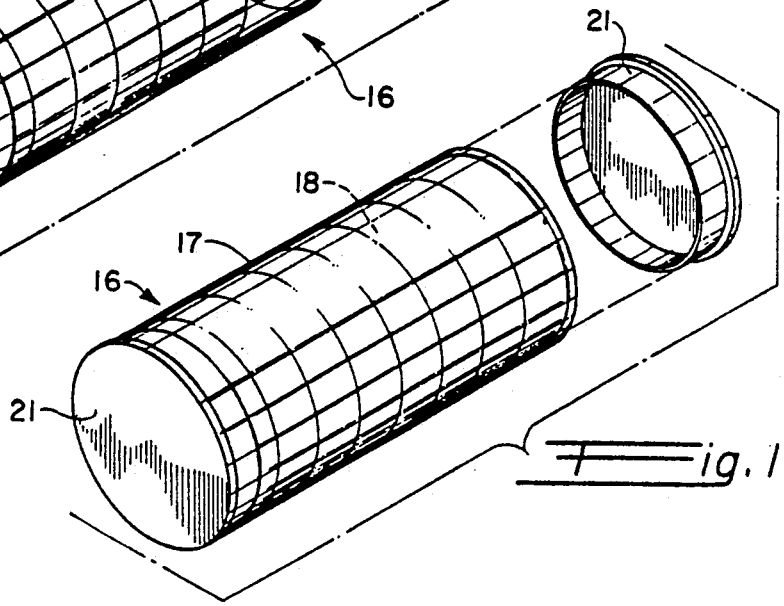

Referring to FIGS. 16 and 17, the cylindrical body portion 17 of the casing 16 has a cap 21 disposed on one of the open opposed ends 20 thereof. The desired weights 18 and/or "fillers" 19 are then received within the cylindrical body 17. The other cap 21 is then disposed on the other of the open opposed end portions 20 of the cylindrical body 17, whereby the weights 18 and/or "fillers" 19 are retained in the cylinder. If desired, these caps 21 may be either removably disposed over each respective end portion 20, whereby the weights 18 and/or "fillers" 19 are removably retained therein, or the caps 21 may be disposed over each respective end portion 20 and integrally secured in place therein, so that the weights 18 and/or "fillers" 19 are permanently retained therein. It is to be noted that the caps 21 may be disposed over each of the end portions 20 in the order described above or a cap 21 may be placed over each respective end portion 20 after the desired weight 18 and/or "fillers" 19 have been disposed in the cylinder 17.

Figure 18:
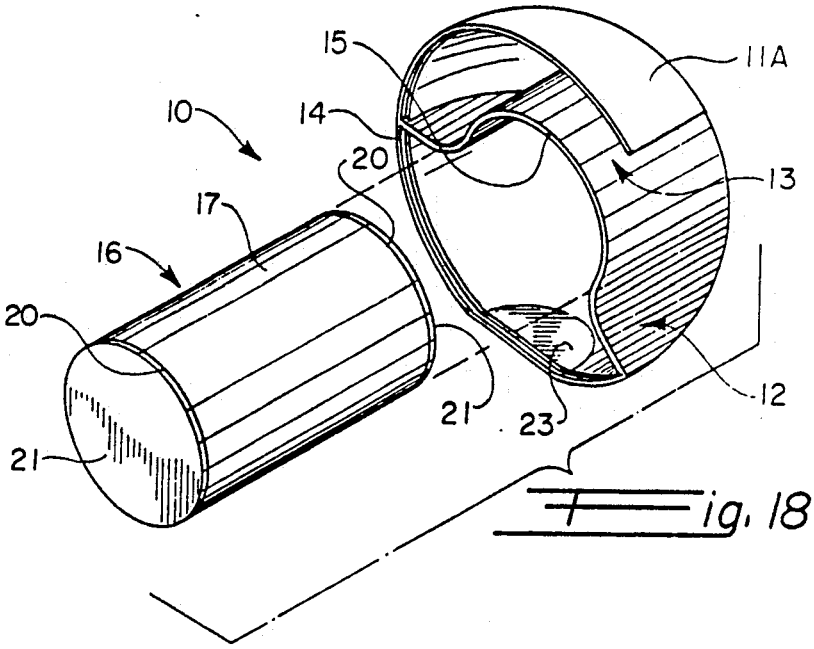
Figure 19:
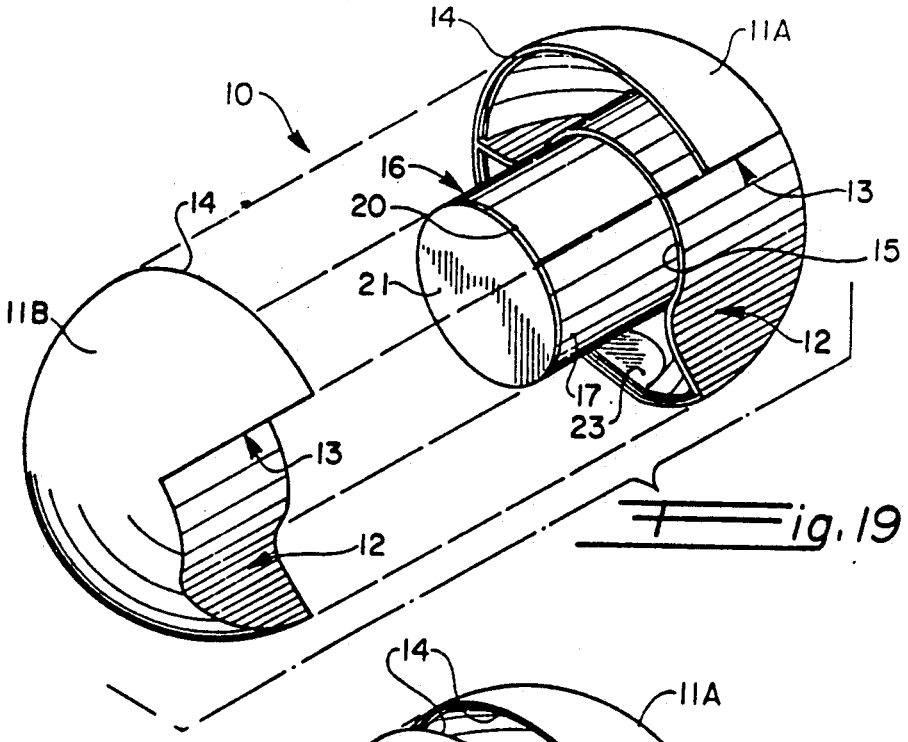
Figure 20:
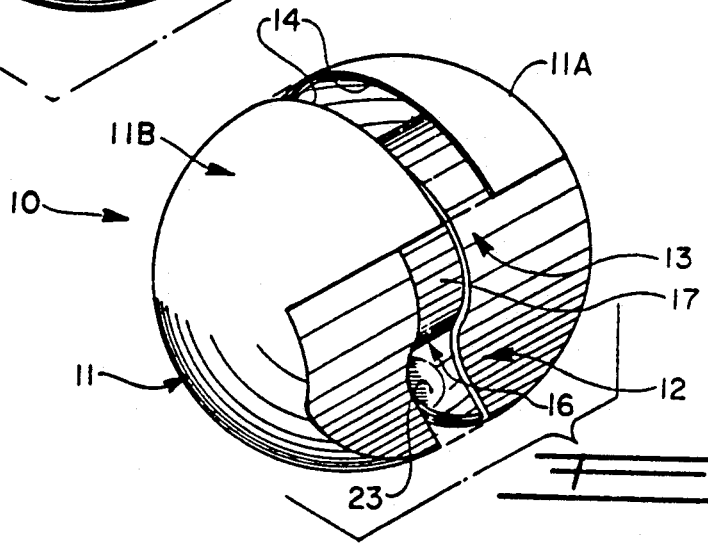

Referring to FIGS. 18–20, the assembled cylindrical casing 16 with the weights 18 and/or fillers 19 therein then has one of the opposed ends 20 inserted into a respective concave inner portion 15 of one of the hemispherical housing portions 11A as shown more clearly in FIG. 18. There, the opposed end 20 is received on and abuts the internal annular shoulder 22, wherein the opposed end 20 of the cylindrical casing 16 is supported. Then the other of the opposed ends 20 is inserted into the other respective concave inner portion 15 of the other hemispherical housing portion 11B (as shown more clearly in FIGS. 19 and 20). There, the other opposed end 20 is received on and abuts the internal annular shoulder 22 therein, wherein the other opposed end 20 of the cylindrical casing 20 is supported.

The respective hemispherical housing portions 11A and 11B are then aligned with one another and brought together, as shown in FIG. 20, such that the arcuate ribbed edges 14 of the hemispherical housing portions 11A and 11B contact one another. The housing portions 11A and 11B are integrally joined together by a suitable adhesive, sonic or ultrasonic welding, or other suitable means. In this manner, a substantially spherical housing 11 having a single diametral axis and a single cut-away portion 12 is formed. The housing 11 further has a single opening 13 formed therein, substantially tangentially of the housing 11 and in communication with the cut-away portion 12 thereof for the hand of the user to be inserted during use, as herein described. If desired, the housing 11 could have a built-in cylindrical casing formed therein to receive the weights 18, etc., in which case a separate cylinder 17 would not be necessary.

Figure 21:
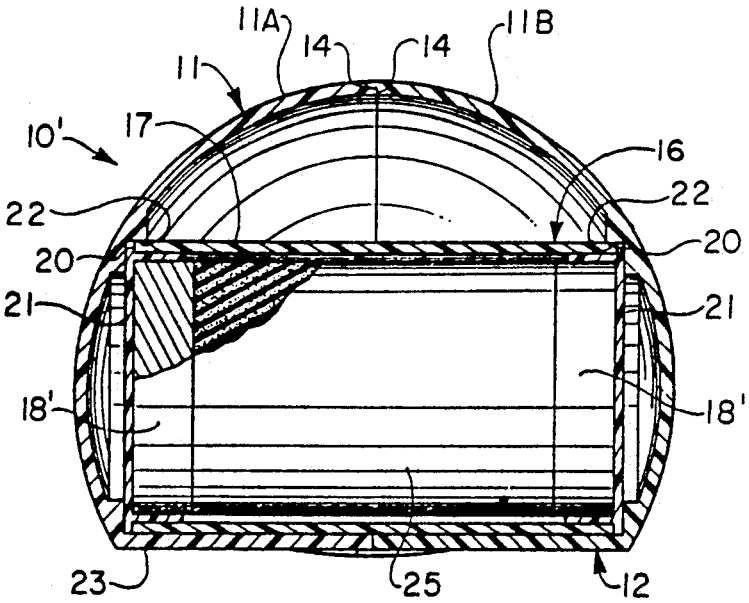
FIG. 21 is a longitudinal section of a second embodiment of the present invention, corresponding substantially to that of FIG. 5, but showing a pair of circular discs separated by a dowel rod to form the cylindrical weight means within the housing.
Figure 22:
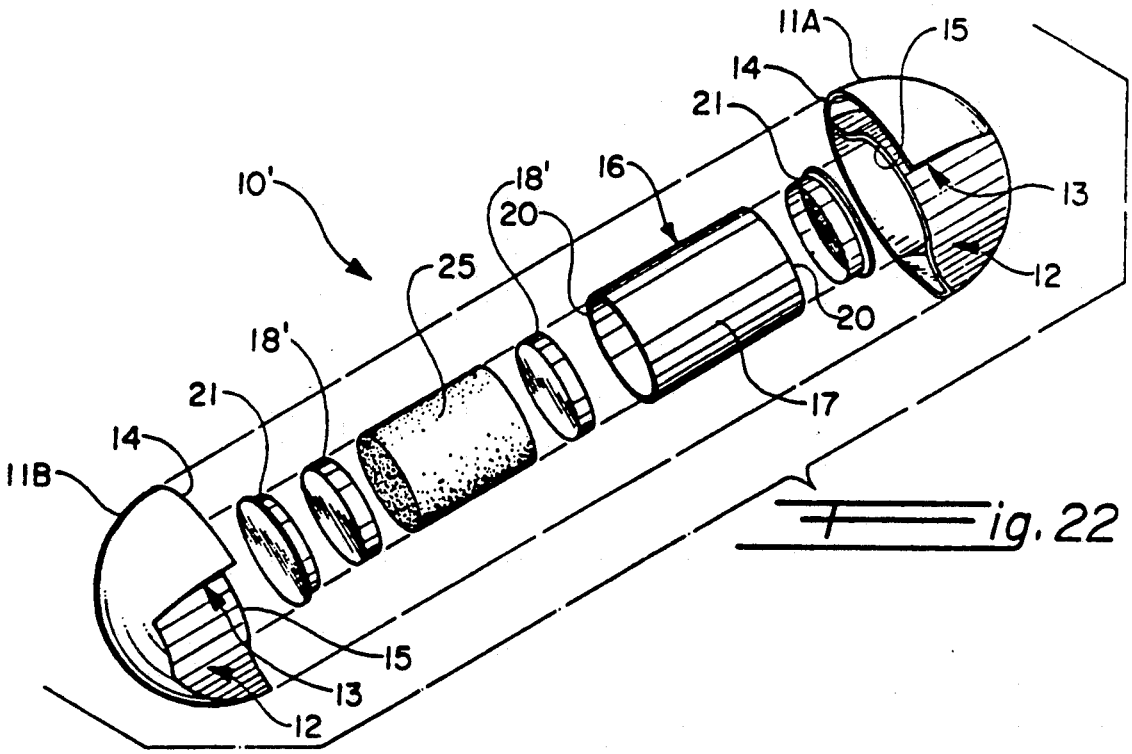
FIG. 22 is an exploded perspective view thereof.

With reference to FIGS. 21 and 22, constituting a first alternate embodiment 10' of the present invention, a pair of disc-shaped weights 18' are separated by a cylindrical "dummy" block or dowel rod 25. The outer diameter ("O.D.") of the weights 18' and the dowel rod 25 remain substantially constant; however, the thickness of the disc-shaped weights 18' (and the length of the cylindrical dowel rod 25) may be changed to provide a heavier (or lighter) weight for the exercise device 10'. This accommodates a range of exercise devices of different weights, thus facilitating an entire product line using the same housing members 11A and 11B. Like the other embodiments of the present invention, this achieves market expansion and penetration consonant with manufacturing standardization.

Figure 23:
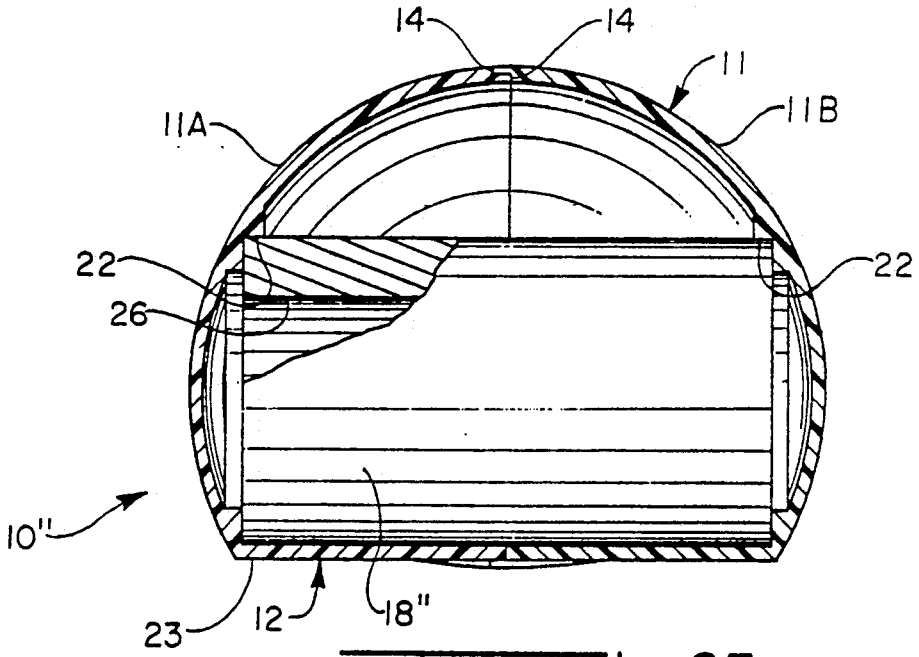
FIG. 23 is a longitudinal section of a third embodiment of the present invention, corresponding substantially to that of FIG. 5, but showing a weighted sleeve to form the cylindrical weight means within the housing.
Figure 24:
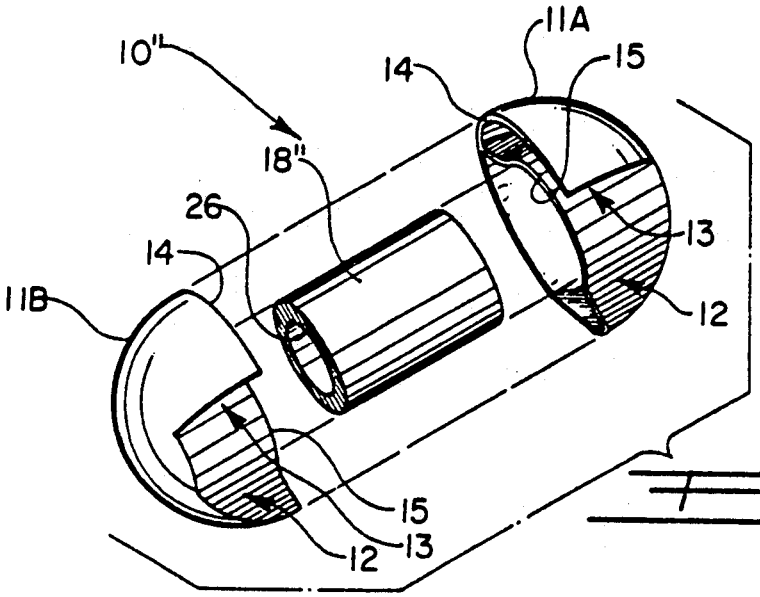
FIG. 24 is an exploded perspective view thereof.

With reference to FIGS. 23 and 24, constituting a second alternate embodiment 10'' of the present invention, a weight 18'' comprising a single cylindrical sleeve is disposed between the respective housing portions 11A and 11B. The cylindrical weight 18'' has a central bore 26 formed therein. Thus, the cylindrical weight 18'' has a substantially constant length; but the bore 26 may have a variable diameter, thereby changing the effective weight thereof for accommodating a desirable product line of exercise devices 10''.

Figure 25:
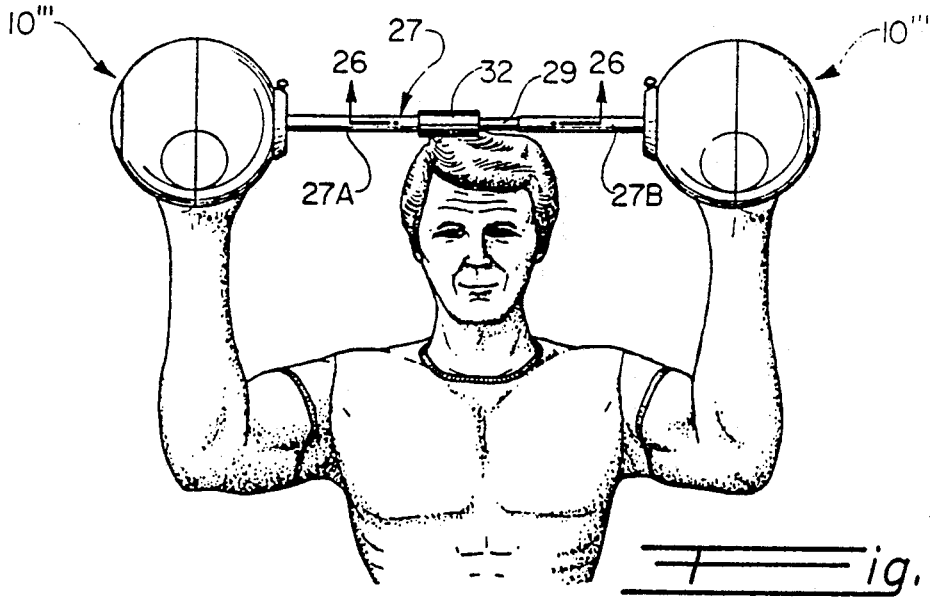
FIG. 25 illustrates how two of the exercise devices of the present invention may be used in combination with a telescoping bar therebetween to form an improved exercise device, the use of which is somewhat similar to that of a conventional barbell.
Figure 26:
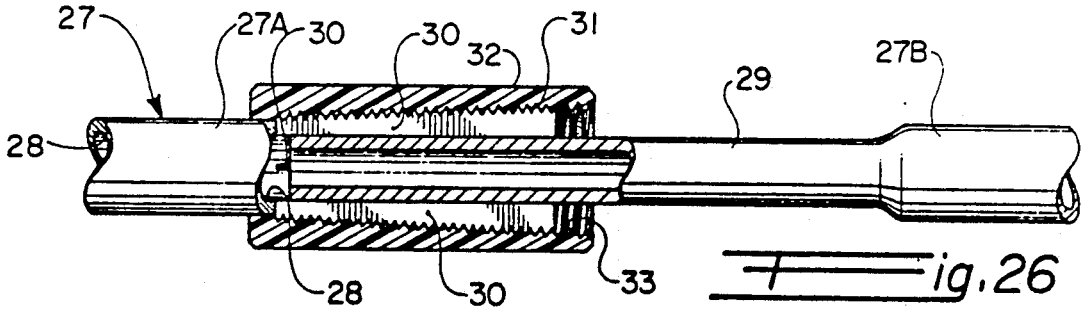
FIG. 26 is a section view (with parts thereof in elevation) taken along the lines 26—26 of FIG. 25, drawn to an enlarged scale, and showing the telescoping members of the bar.
Figure 27:
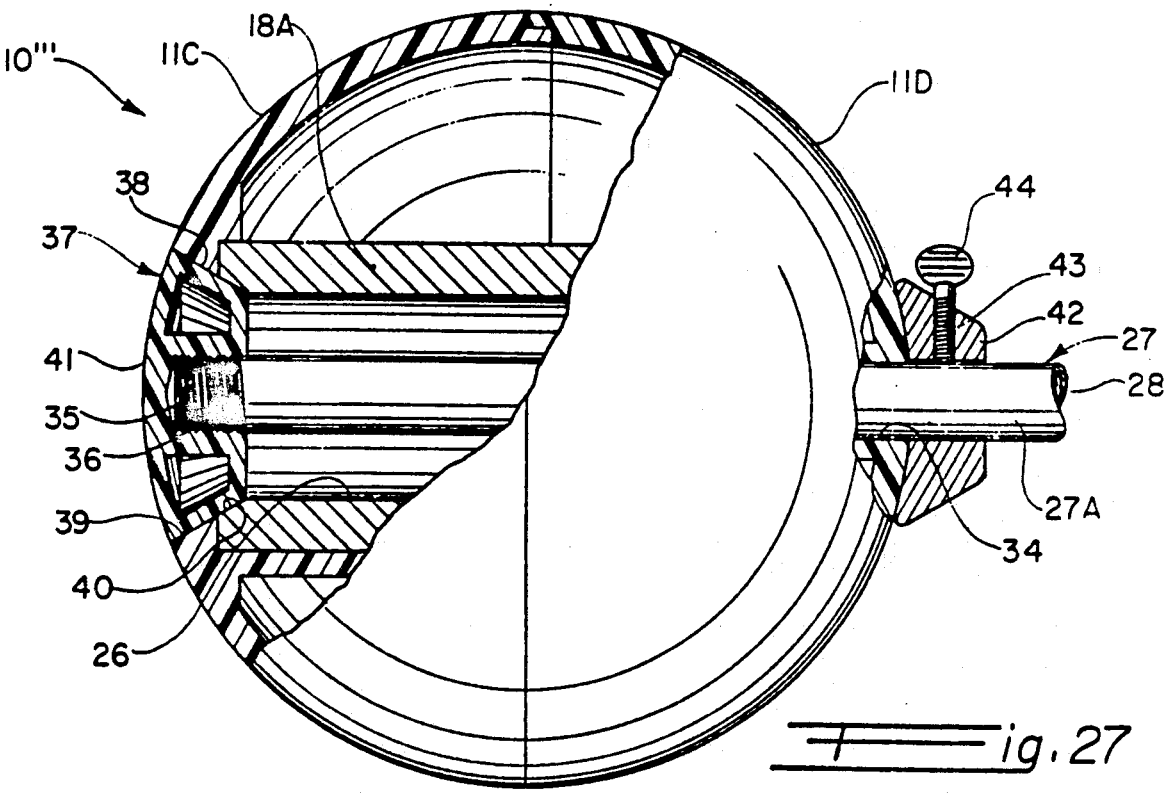
FIG. 27 is a further section view, taken along the lines 27—27 of FIG. 25, drawn to an enlarged scale, and showing the coupling of one of the exercise devices of the present invention to the telescoping bar.

With reference to FIGS. 25–27, a pair of exercise devices of the present invention may be suitably coupled together to form a barbell type of device.

More specifically, an exercise device 10''' is carried on the respective ends of a bar 27. The bar 27 includes telescoping bar members 27A and 27B. Bar member 27A is preferably tubular and has an axial bore 28 to receive a reduced-diameter portion 29 of bar member 27B, as shown more clearly in FIG. 26. Bar member 27A has four circumferentially-spaced slots 30 formed therein, and the outer diameter of bar member 27A is provided with external threads 31 radially of the slots 30. The reduced-diameter portion 29 of bar member 27B is slidably received in the axial bore formed in the tubular bar member 27A to the desired depth to adjust the length of the bar 27 to suit the convenience of the individual user. A clamping collar 32 is slidably carried by the bar member 27A and has an internal taper which is complementary to the external taper on the bar member 27A. The clamping collar 32 has internal threads 33 which engage the external threads 31 on the bar member 27A and exert a radially inwardly-directed pressure on the respective portions of bar member 27A intermediately of the circumferentially-spaced slots 30 formed thereon, thereby securely clamping the bar member 27A to the reduced-diameter portion 29 of the bar member 27B, and thereby retaining the bar 27 in its desired adjusted length. However, it will be appreciated by those skilled in the art that other means for adjusting the length of the bar 27 may be employed consonant with the teachings of the present invention.

With further reference to FIG. 27, the exercise device 10''' includes housing halves 11C and 11D integrally joined together at their peripheral ribbed edges 14, respectively, and exercise device 10''' carries a sleeve weight 18A having a bore 26. Housing half 11D has an opening 34 to receive the bar member 27A, which is telescopically received concentrically within the sleeve weight 18A. The end of bar member 27A is threaded, as at 35, to cooperate with the internally-threaded boss 36 of a clamping disc 37. Clamping disc 37 has a conical or tapered side surface 38 which wedges within a complementary internally-tapered or conical opening 39 formed in housing half 11C. The tapered surface 38 of clamping disc 37 also wedges against an annular chamfered surface 40 formed on the sleeve weight 18A, thereby securely retaining the weight 18A within the housing halves 11C and 11D. The outer surface 41 of clamping disc 37 is formed as a portion of a sphere (as shown more clearly in FIG. 27) so that in the overall assembly, the outer surface 41 of clamping disc 37 forms a smooth continuation of the spherical contours of the exercise device 10''' and, more particularly, its housing half 11C. The bar member 27A also carries a slidable locking collar 42 provided with a set screw 43 having a thumb-actuated portion 44, thereby retaining the exercise device 10''' on the bar member 27A. Bar member 27B has a similar connection with exercise device 10'''. With this arrangement, the exercise devices may be quickly and conveniently removed from the bar 27 and replaced with exercise devices having different weights, as desired, so that the full range of the dual exercise devices is facilitated.

With reference to FIGS. 28–35, the wide-ranging utility and application of the present to the accelerated development of various targeted muscles of the user, besides the bicep illustrated in FIG. 1, will be more readily appreciated. In FIGS. 28–35, the full lines illustrate the natural "at rest" positions, while the broken lines illustrate the stressed positions during use of the exercise device of the present invention. Moreover, it will be appreciated by those skilled in the art that the respective representations of FIGS. 28–35 are illustrative of the present invention and not limiting thereof.

Figure 28:
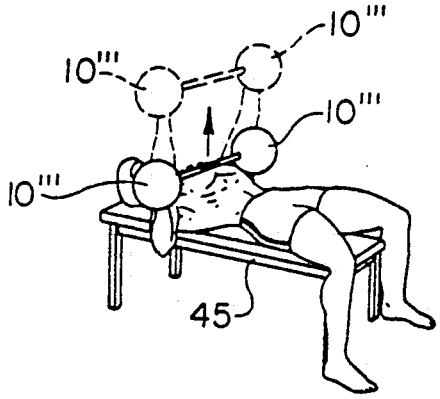
FIGS. 28-35 schematically illustrate various examples for use of the exercise devices of the present invention for the development and improvement of respective targeted muscles.
Figure 29:
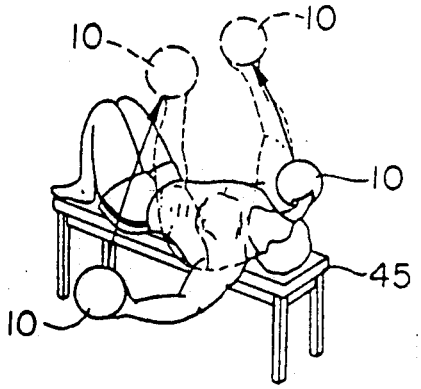
Figure 30:
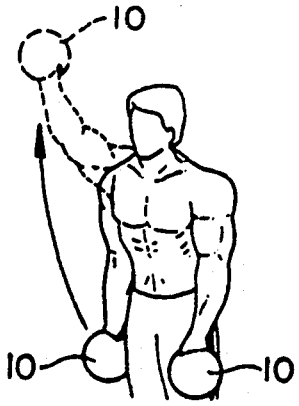
Figure 31:
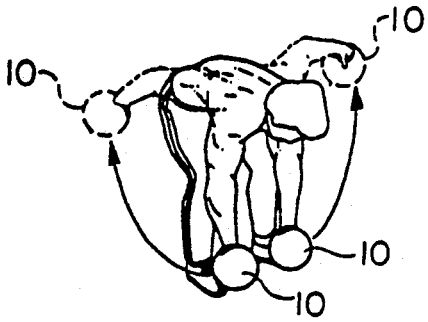
Figure 32:
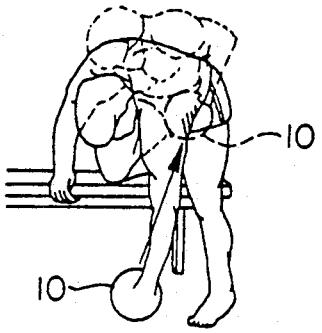
Figure 33:
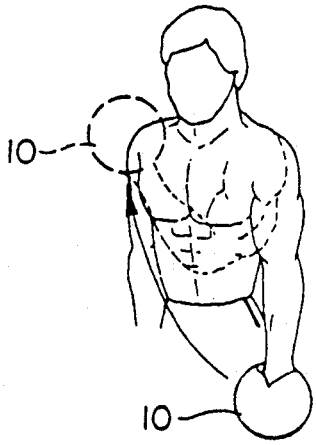
Figure 34:
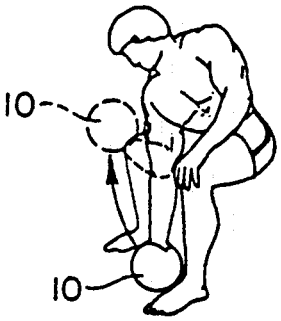
Figure 35:
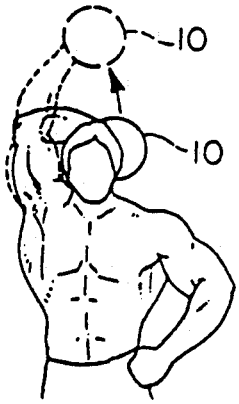

With this in mind, FIG. 28 and 29 illustrate the use of the exercise devices of the present invention for primarily developing and strengthening the chest muscles, as the user lies on a bench 45. FIGS. 30 and 31 illustrate the use of the exercise devices for primarily strengthening the shoulder muscles; FIG. 32 for the back muscles; and FIGS. 33–35 are for the arm muscles. FIG. 30 is a front deltoid raise. FIG. 31 is a bent-over lateral raise; FIG. 32 is a one-arm latissimus row; FIG. 33 is an alternate bicep curl; FIG. 34 is a bicep concentration curl; and FIG. 35 is a tricep extension.

In each case, the user's specific targeted muscle is being developed and strengthened. Since it is not required to exert a firm grip or grasp on the improved exercise devices of the present invention, the use of the adjoining or conjunctive muscles is at least substantially reduced, if not eliminated altogether. Thus, a smaller overall weight may be employed in the exercise devices, yet the beneficial effect will be substantially magnified; and, in a preferred embodiment, the improved exercise devices of the present invention have a beneficial effect which is substantially equal to a conventional weight of approximately 3.5 times the weight of the exercise device of the present invention. Viewed in another aspect, it will be appreciated that with the same exercise time period, the beneficial effect of the exercise devices of the present invention will be substantially enhanced over the use of the conventional devices of the prior art; or, conversely, a substantially reduced exercise time period may be employed to achieve approximately the same beneficial effect normally obtained by using a conventional device over a substantially larger exercise time period.

Moreover, with the same basic design, it is possible to manufacture and market a wide range of exercise devices of various respective weights. Thus, an entire product line has been facilitated for rapid development and market expansion and penetration, yet consonant with manufacturing standardization and relatively low-cost volume production methods.

Obviously, many modifications may be made without departing from the basic spirit of the above invention. For example, the cylindrical casing 16 may be dispensed with (if desired) and complementary cylindrical casings could be integrally molded within the hemispherical housing portions 11A and 11B, such that the desired weights 18 (and/or fillers 19) may be received directly therein. Additionally, the housings for the exercise devices of the present invention may be made of a relatively soft or pliable material, thereby customizing the exercise devices for use by children or handicapped persons going through physical therapy. Indeed, it is even feasible, consonant with the teachings of the present invention, to integrally cast or otherwise suitably form the exercise devices of a substantially solid material (with or without an internal ballast) yet having the same tangential opening and convexo-concave inner wall or surface to accommodate the user's hand without requiring the user to exercise a forceful grip.

Referring to FIGS. 36–40, an alternate embodiment of the exercise devices of the present invention is illustrated. This embodiment has improved strength and flexibility, incorporates all of the desirable features of the previous embodiment, and yet facilitates standardized manufacture of the devices with relatively large variations in weight being readily accommodated. In this alternate embodiment, the peripheral edges of the housing portions have a solid tongue-and-groove mating relationship with one another, and the respective housing portions are secured to respective opposite ends of the weight means.

Like the previous embodiments of the exercise devices described above, the exercise device 100 includes a housing 101 having a weight means disposed therein. Preferably, the wall thickness of this housing 101 is larger than the thickness of the housing wall of the previous embodiments.

As was described for the previous embodiments, a tangential opening 102 is formed in the housing 101. This opening 102 is bounded by an outer wall 103 and by an inner wall 104. Inner wall 104 has a convex portion 105, and outer wall 103 has a concave portion 106. The hand of the user may be inserted through the tangential opening such that the user's hand is disposed between the inner and outer walls 103 and 104, respectively.

As previously described, the palm of the user's hand is disposed adjacent to the convex portion 105 of the inner wall 104, and the heel of the user's hand is disposed adjacent to the concave portion 106 of the outer wall 103. Thus, a forceful grip is not required by the user during use of the exercise device 100, thereby substantially reducing the necessity for employing the user's conjunctive adjoining muscles, which would (otherwise) have a tendency to detract from the development of the user's targeted muscle.

The opposite ends of the weight means 107 are removably secured to respective diametrically-opposed portions or shells 101A and 101B of the housing 101, and the peripheral annular edges of the respective housing portions 101A and 101B are held together in a solid mating relationship.

Figure 36:
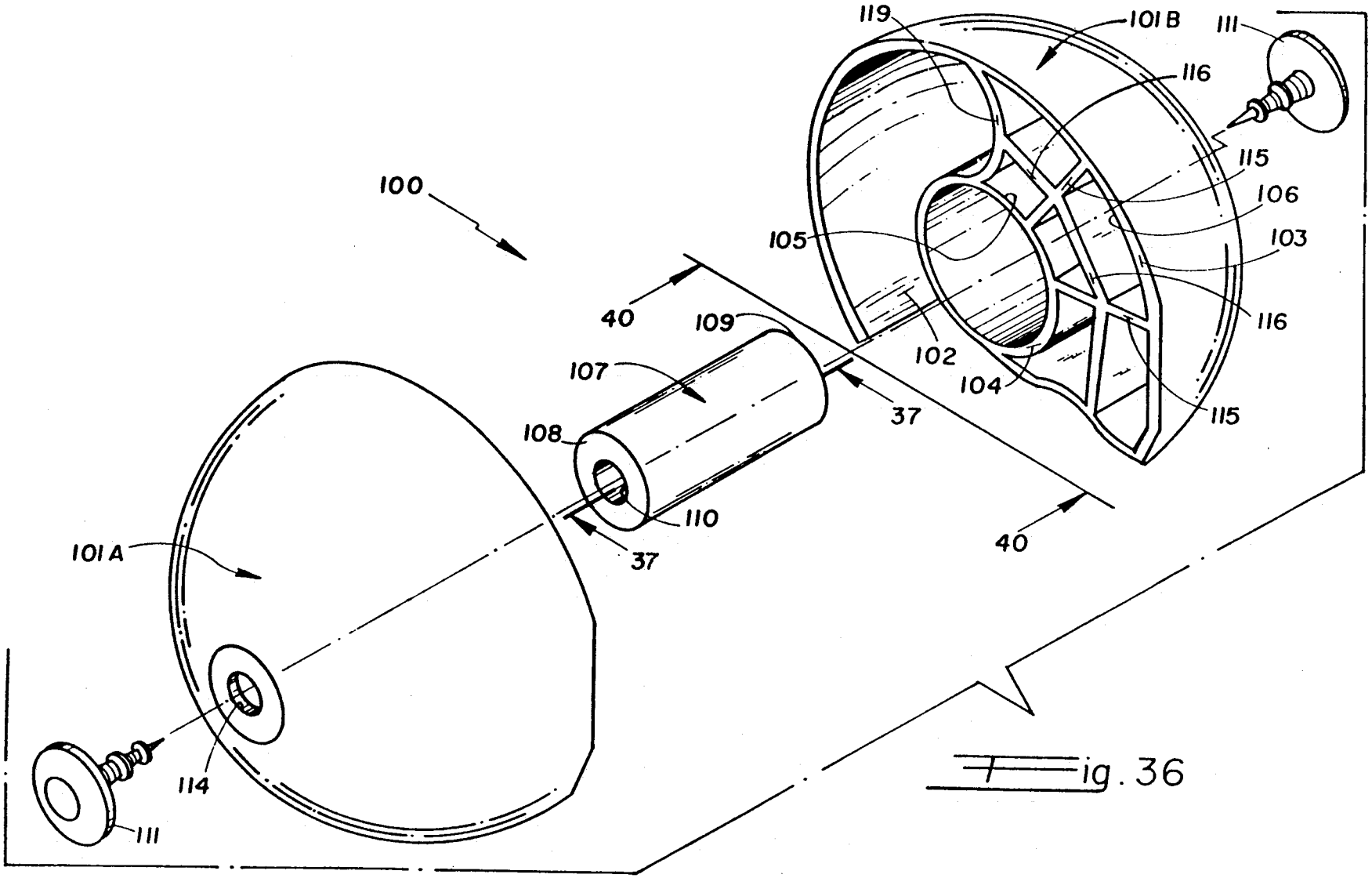
FIG. 36 is an exploded perspective view of a fourth embodiment of the present invention, wherein the ends of the weight are removably secured to the housing portions by cap screws, respectively, and wherein the outer diameter of the weight may be changed to vary the weight of the exercise device.
Figure 37:
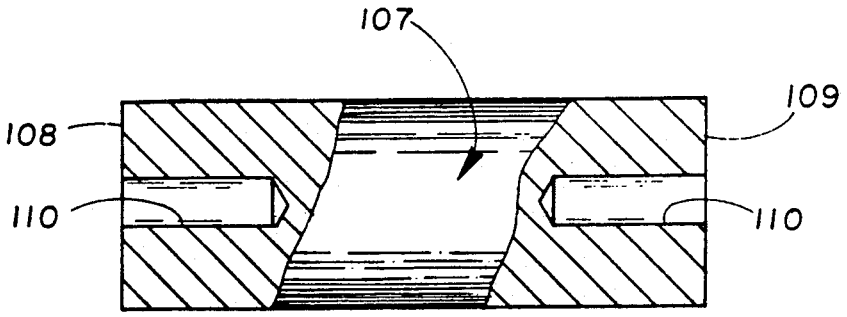
FIG. 37 is a longitudinal cross-section of the weight means, taken along line 37—37 of FIG. 36 and drawn to an enlarged scale.

Referring to FIGS. 36 and 37, preferably the weight means 107 comprises a single solid weight having a pair of opposite ends 108 and 109. It is contemplated herein that this weight 107 (like the cylinder 16 of, for example, FIG. 8) will be substantially cylindrical in cross-section. However, other configurations of the weight means 107 are equally applicable consonant with the teachings of the present invention. Preferably, each of the opposite ends 108 and 109 of the weight 107 has a blind axial bore 110 formed therein. These opposite ends 108 and 109 are secured to the respective diametrically-opposed portions 101A and 101B of the housing 101 by a suitable fastening means.

The annular peripheral edges of the two molded hemispherical housing shells 101A and 101B join together along a common longitudinal midplane constituting the parting line of the housing 101, and the weight 107 is secured between the housing shells 101A and 101B transversely of the common longitudinal midplane therebetween.

The provision of the single weight 107 (secured directly to the housing portions 101A nd 101B) eliminates potential slippage and shifting of the weight in the housing 101. Thus, the exercise device 100 has increased stability during the use thereof.

Having a single weight also standardizes the manufacture of the exercise devices. The effective quantity of the weight 107 may be varied by varying the outer diameter ("O.D.") thereof. In the previous embodiments (described above) the outer diameter of the weight means remains constant, with the effective quantity (or weight) of the weight means being varied by varying the inner diameter thereof. Altering of the inner diameter, or requiring the use of many more weights, is more expensive. In this respect, the use of the single solid weight 107 avoids manufacturing problems, provides standardization, and facilitates an improved product having greater reliability.

Figure 38:
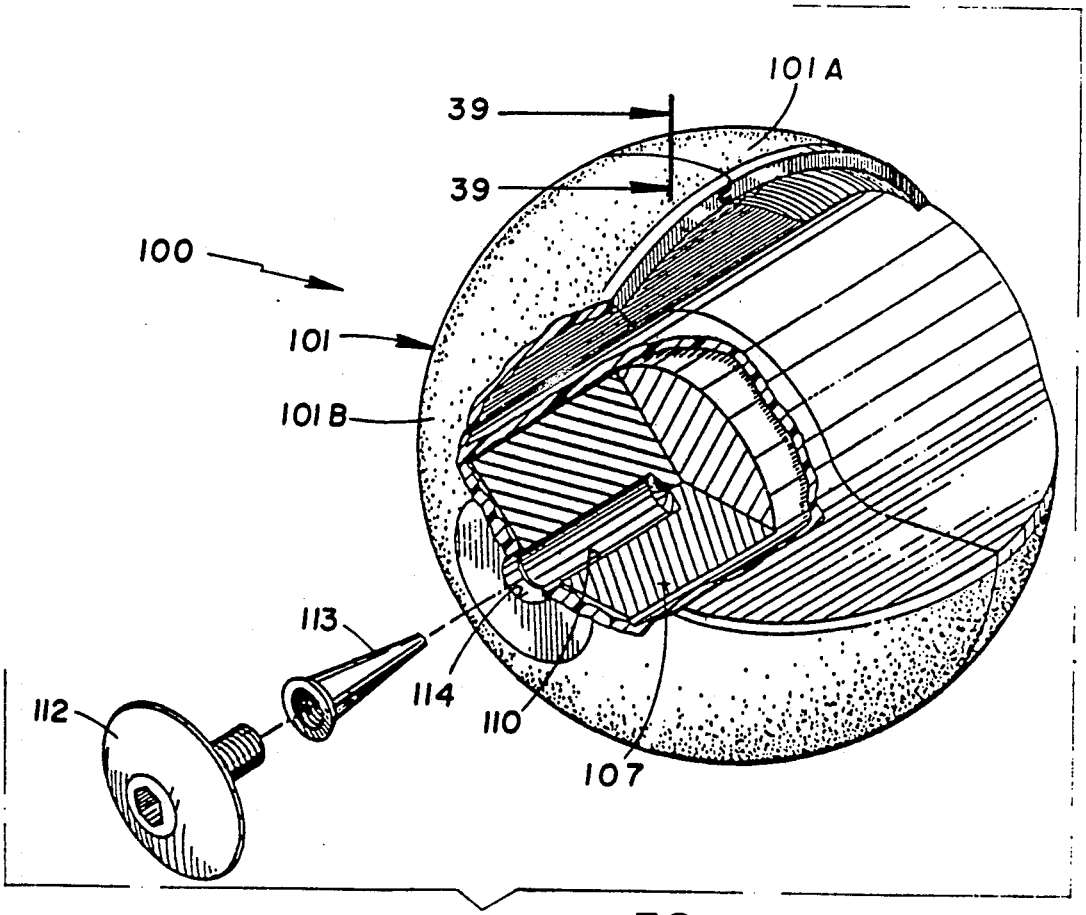
FIG. 38 is a perspective view of the embodiment of FIG. 36 in its assembled relationship, but with certain parts thereof broken away and sectioned, and further showing an alternate fastening means.

The means for securing each of the opposite ends 108 and 109 of the weight 107 to the respective diametrically-opposed portions 101A and 101B of the housing 101 includes a pair of cap screws 111 (or other suitable fastening means). Each of the cap screws 111 is directly inserted and received in a respective bore 110 in the weight 107. These cap screws 111 may be self tapping (as shown in FIG. 36); however, if desired, a screw 112 may cooperate with an expandable anchor 113 which is inserted into the bore 110, as shown in FIG. 38. The anchor 113 expands as the screw 112 is received in the bore 110 in the weight 107. The screws (111 or 112) pass through apertures 114 in the housing portion 101A and 101B, respectively.

In this manner, the housing portions 101A and 101B of the housing 101 are removably secured to the opposite ends 108 and 109, respectively, of the weight 107, such that the housing portions 101A and 101B are removably secured to each other.

Figure 40:
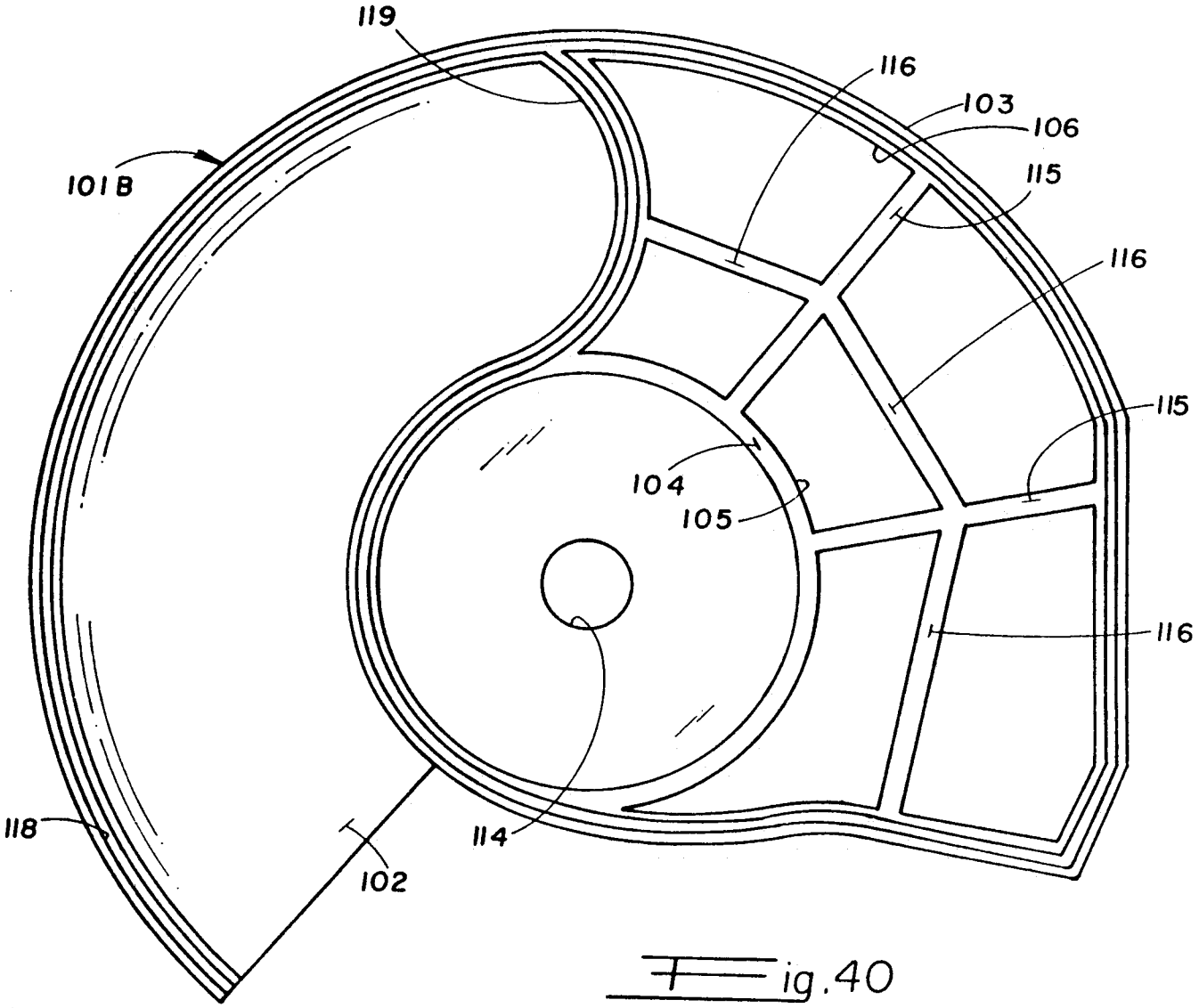
FIG. 40 is a first elevational view of one of the housing portions or shells, as viewed from the lines 40—40 of FIG. 36 and drawn to an enlarged scale.

Each housing portion 101A and 101B has a plurality of radially-extending respective strengthening ribs (or struts) 115 formed thereon, as shown more clearly in FIG. 40. These struts 115 extend between the inner (convex) wall 104 and the outer (concave) wall 103 of each housing half 101A and 101B. Additionally, cross ribs 116 join the struts 115 (being integrally molded therewith) to provide additional radial and circumferential strength to the housing portions 101A and 101B. These struts 115 and cross ribs 116 are desirable where a particularly heavy weight (i.e. forty pounds or heavier) is disposed in the exercise device 100 (but may not be necessary where lighter weights are employed).

Figure 39:
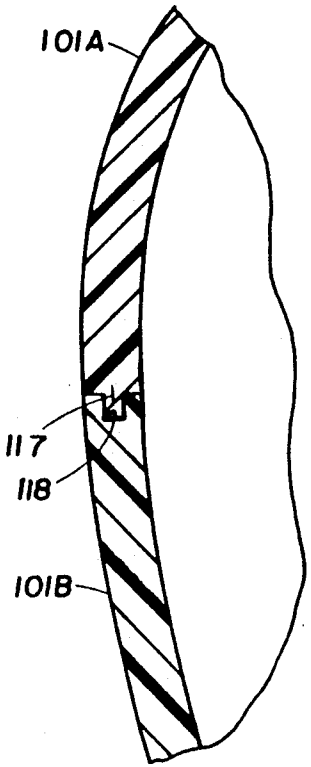
FIG. 39 is a partial cross-sectional view thereof, taken along the lines 40—40 of FIG. 38 and drawn to an enlarged scale, and showing the tongue-and-groove mating relationship of the two hemispherical housing portions or shells along their respective annular peripheries.

Referring to FIG. 39, in addition to FIG. 36, the housing portions 101A and 101B are keyed together by a tongue-and groove arrangement, which permits the peripheral edges of the housing portions 101A and 101B to mate solidly with one another. In this arrangement, the annular peripheral edge of one of the housing portions 101A (or 101B) has an annular tongue 117 formed thereon; and the annular peripheral edge of the other of the housing portions 101B (or 101A) has a complementary annular groove 118 formed therein and sized so as to receive the tongue 117 therein in a mating relationship. This tongue-and-groove arrangement provides greater security against slippage or relative movement of the housing portions 101A and 101B relative to one another, especially when the exercise device 100 is under greater stress due to the use of heavier weights.

An internal wall 119 (see FIG. 36) limits the insertion of the user's hand in the exercise device 100 (similar to the internal wall shown in FIG. 3 of the previous embodiments). This internal wall 119 projects radially and joins the inner wall 104 to the outer wall 103.

The Improved Handles For A Variety Of Apparatuses

Figure 41:
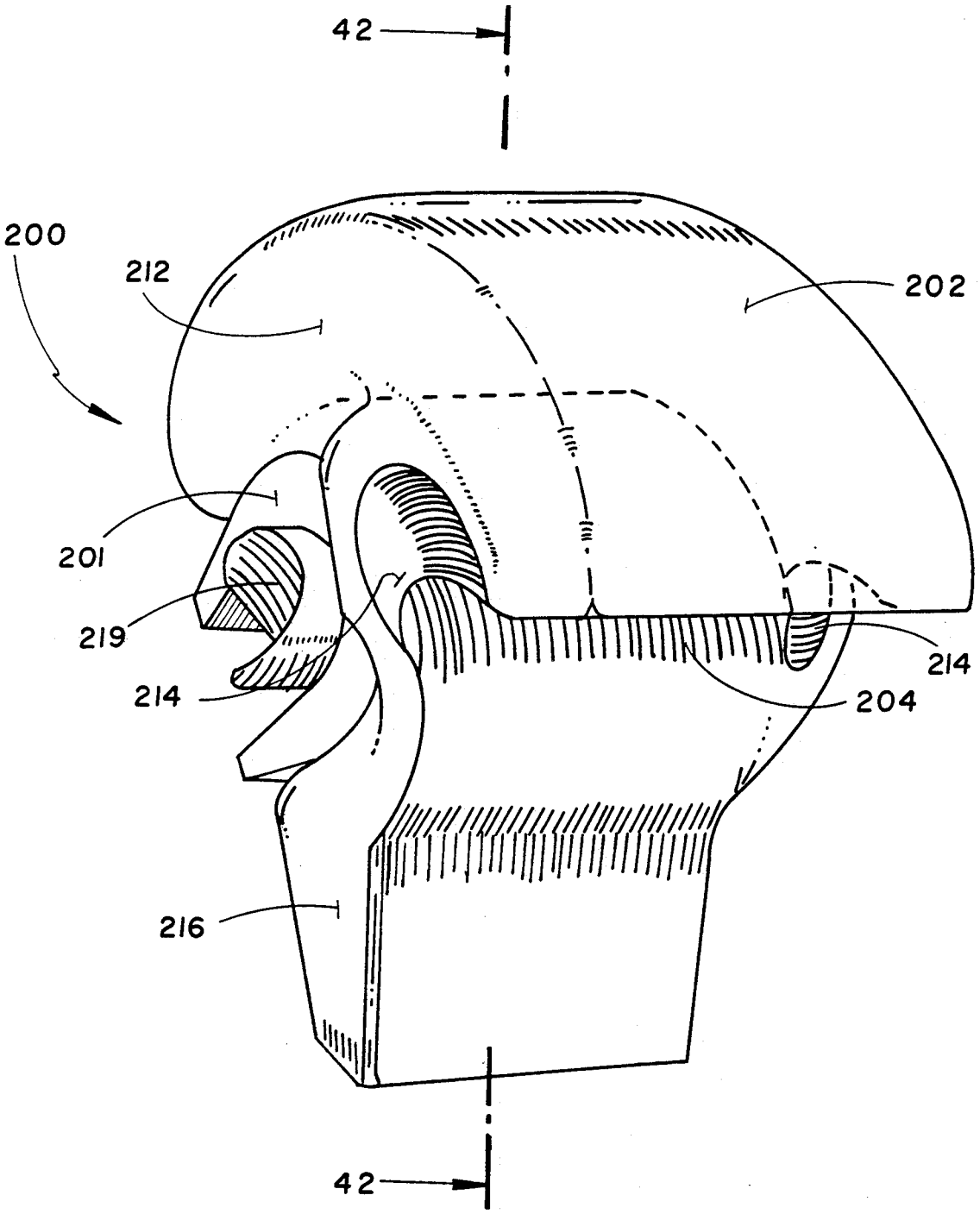
FIG. 41 is a perspective view of the improved handle of the present invention, shown as an attachment for an existing handle, and with the securing means partially removed for ease of illustration.

With reference to FIG. 41, there is illustrated an improved handle 200 of the present invention. This improved handle 200 may be incorporated integrally on a particular device or apparatus, or provided as a removable retrofit attachment constituting an auxiliary handle for the existing handle of the device or apparatus, consonant with the teachings of the present invention.

Figure 42:
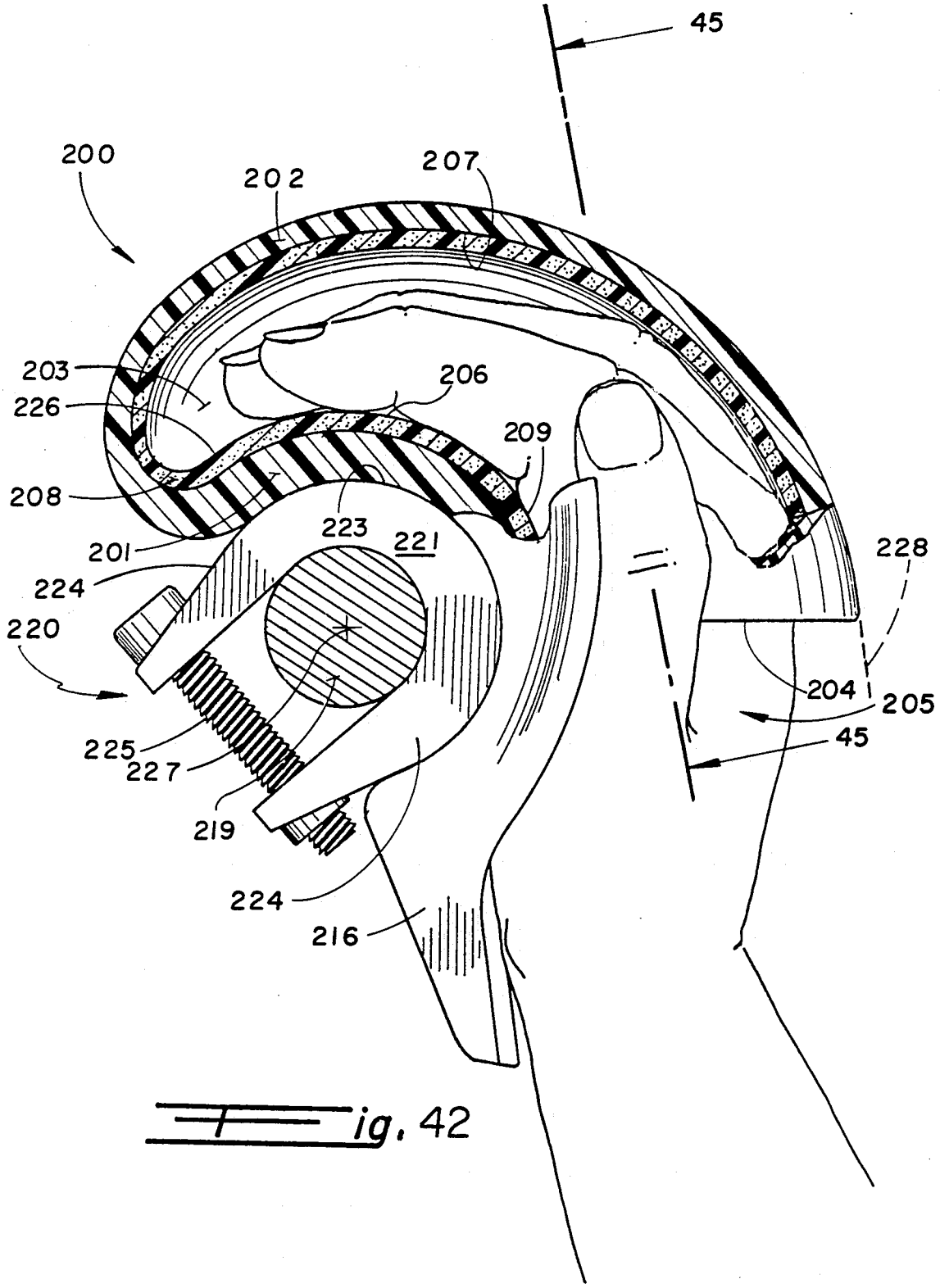
FIG. 42 is a longitudinal section thereof, taken along the lines 42—42 of FIG. 41, showing the user's hand in its curved natural at rest position within the handle, such that a forceful grip on the existing handle is not necessary, and further showing the means for removably securing the handle to an existing handle of an apparatus.

With reference again to FIG. 41, and with further reference to FIGS. 42 and 43, the improved handle 200 of the present invention is substantially unitary and has an inner wall 201, an outer wall 202, and a chamber 203 defined therebetween. Preferably, the handle 200 may be integrally molded from a suitable plastic material (such as a polycarbonate) or, if desired, may be fabricated from any suitable material. The handle 200 further has an opening 204 formed therein and communicating with the chamber 203 for providing access for the user's hand, the latter being denoted at 205. As shown more clearly in FIG. 42, the user's hand 205 is disposed in the chamber 203 between the inner wall 201 and the outer wall 202 of the handle 200. Viewed from within the chamber 203, the inner wall 201 has a convex inner surface 206, and the outer wall 202 has a concave inner surface 207. Preferably, each surface 206 and 207 is provided with a padding or cushioned layer 208. As shown, the padding 208 is continuous and has a uniform cross-section. However, if desired, the padding 208 may be discontinuous (or interrupted) and may have a non-uniform cross-section. Also, depending upon the use of the handle 200, the padding 208 may not be absolutely necessary.

With this arrangement, the palm 209 of the user's hand 205 substantially rests on the convex inner surface 206 of the inner wall 201, and such that the back 210 of the user's hand 205 substantially confronts the concave inner surface 207 of the outer wall 202. Depending upon the size of the particular user's hand, the size of the handle 200, and the specific application of the handle 200 and its mode of use in a particular apparatus or device, the back 210 of the user's hand 205 may (or may not) touch the padding or cushioned layer 208 on the inner concave surface 207 of the outer wall 202.

Accordingly, the user's hand is substantially in a curved natural "at rest" position—rather than being tightly closed as is normally required in gripping a handle of the prior art—thereby substantially reducing the effort required to manipulate or control the apparatus associated with the handle 200, and thereby substantially reducing the fatigue normally associated therewith.

Figure 44:
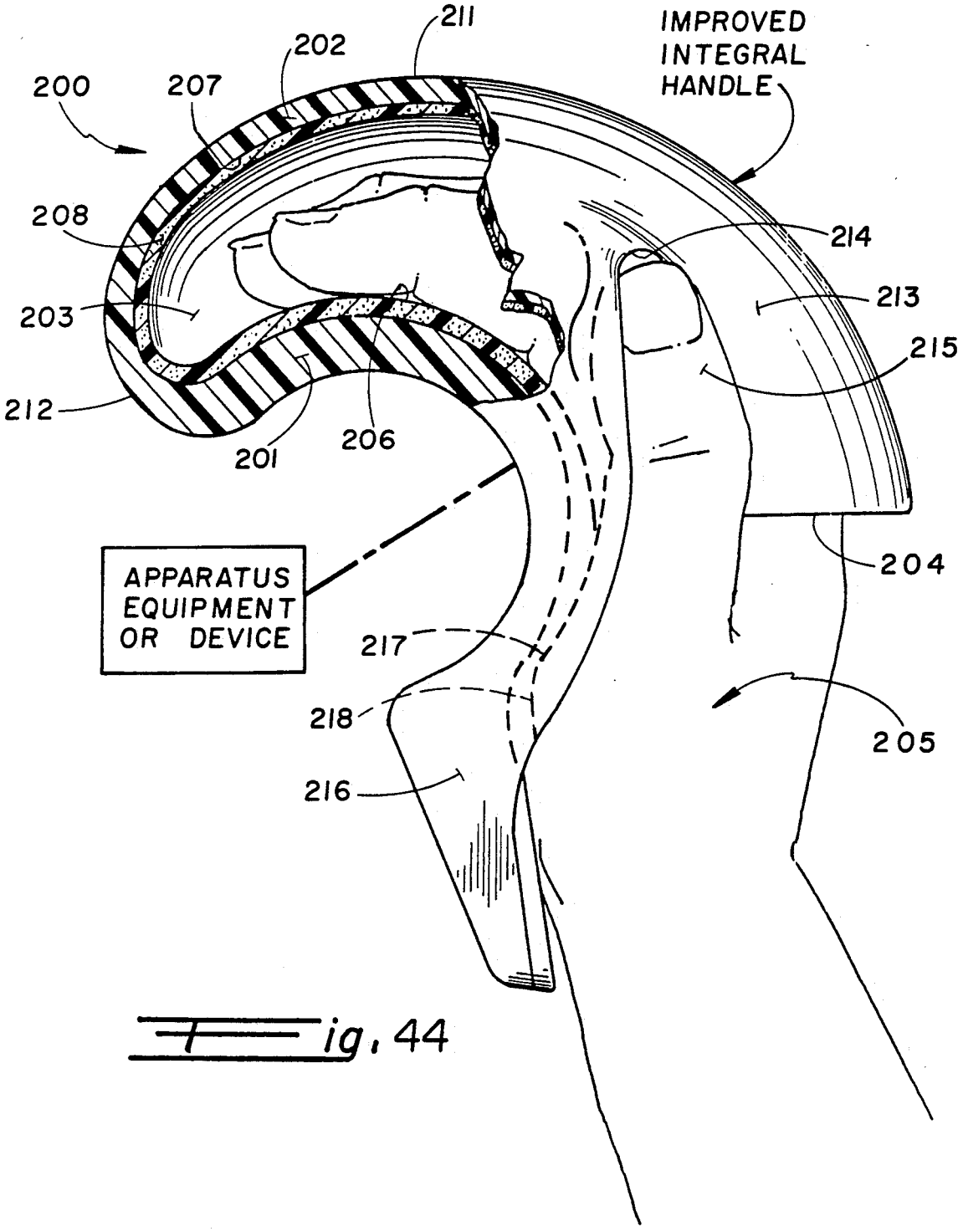
FIG. 44 corresponds to FIG. 42, but illustrates (schematically) how the improved handle of the present invention may be integrally fashioned with an apparatus, equipment or device, rather than being a retrofit attachment for the existing handle of an apparatus, equipment or handle.
Figure 45:
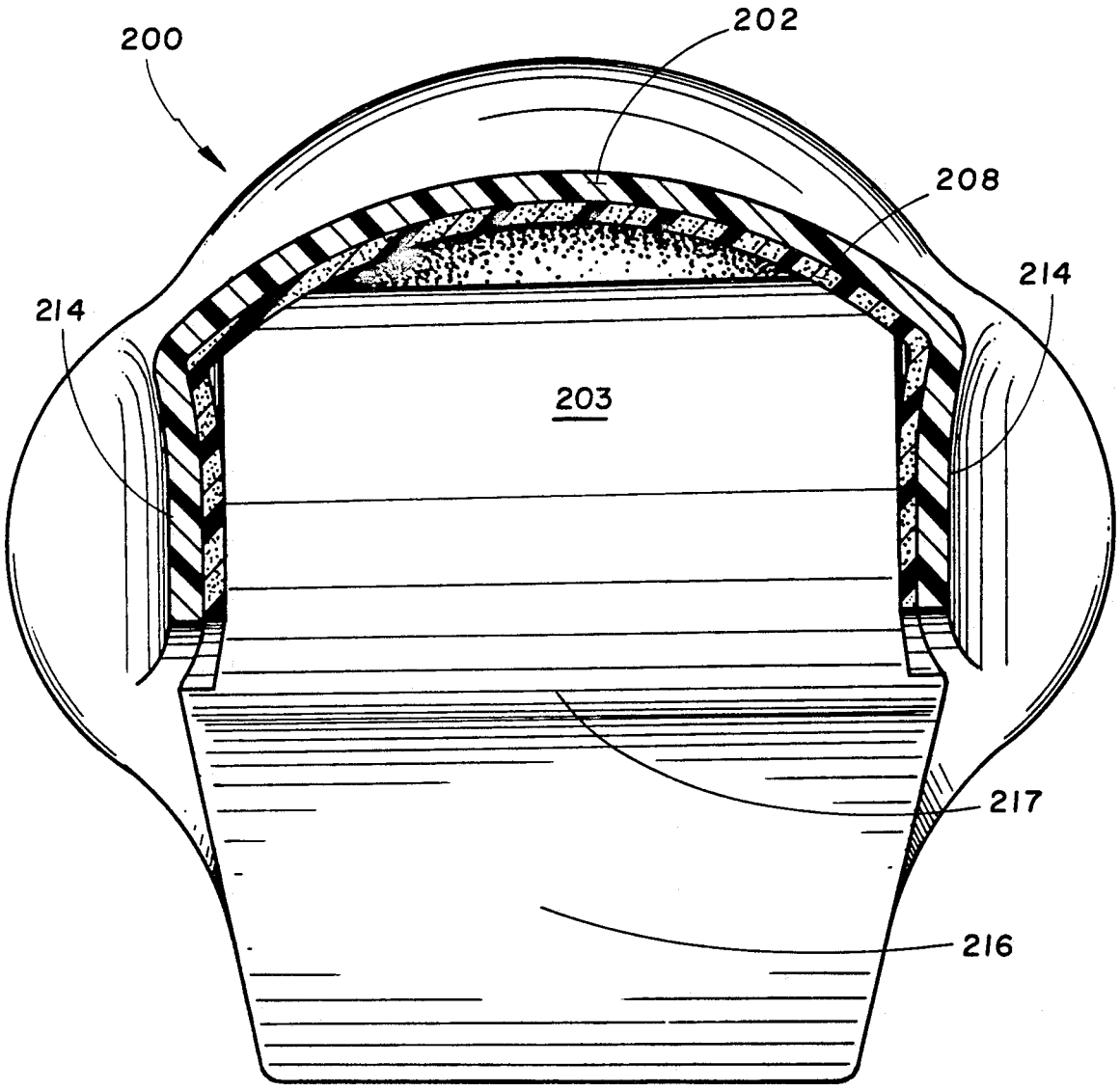
FIG. 45 is a cross-sectional view, taken along the lines 45—45 of FIG. 42 and omitting the user's hand for ease of illustration, and showing the respective indentation in each side wall of the handle, such that the user's thumb may rest conveniently in an indentation, and such that the handle may be used by either the right hand or the left hand.

As shown schematically in FIG. 44, the improved handle 200 of the present invention may be fashioned integrally with an apparatus, equipment or device (or as a retrofit attachment as hereinafter described).

With reference again to FIG. 42, and viewed externally of the handle 200, the outer wall 202 further has a convex outer surface 211; and the inner wall 201 and the outer wall 202 are joined together at an outer extremity 212 of the handle 200. Thus, the chamber 203 gradually narrows in height between the inner wall 201 and the outer wall 202 of the handle 200 in the direction from the opening 204 to the outer extremity 212 of the handle 200.

The handle 200 further has a pair of substantially parallel side walls 213 joining the inner and outer walls 201 and 202, respectively, as shown more clearly in FIG. 43. Each of the side walls 213 is provided with a "dimple" or recessed indentation 214, such that the thumb 215 of the user's hand 205 may rest in an indentation 214 of a respective side wall 213, and such that the pair of indentations 214 in the respective side walls 213 facilitate use of the handle by either the right hand or the left hand of a person.

The inner wall 201 further has a continuation 216 thereof extending past the opening 204 in the handle 200 and including a substantially concave portion 217, such that the heel 218 of the user's hand 205 (adjacent to the palm 209 thereof) may rest against the concave portion 217 of the continuation 216 of the inner wall 201.

When the handle 200 of the present invention is fashioned as an attachment to the existing handle 219 of an apparatus, as shown more clearly in FIG. 42, a means 220 is provided for removably securing the handle 200 to the existing handle 219 of the apparatus. Preferably, this means 220 includes a C-clamp 221 secured to the inner wall 201 of the attachment handle 200 and projecting outwardly therefrom. If desired, the C-clamp 221 may be integrally molded with the attachment handle 200. The C-clamp 221 has a convex surface 222 which is substantially nested within the concave outer surface 223 of the inner wall 201. The C-clamp 221 has a pair of legs 224 straddling the existing handle 219 of the apparatus, and a screw 225 (or other suitable fastening means) is provided for tightening the legs 224 of the C-clamp 221 on to the existing handle 219. It will be appreciated, however, that the C-clamp 221 is exemplary of a wide variety of attachment means, and that other attachment means are equally applicable consonant with the teachings of the present invention.

Figure 43A:
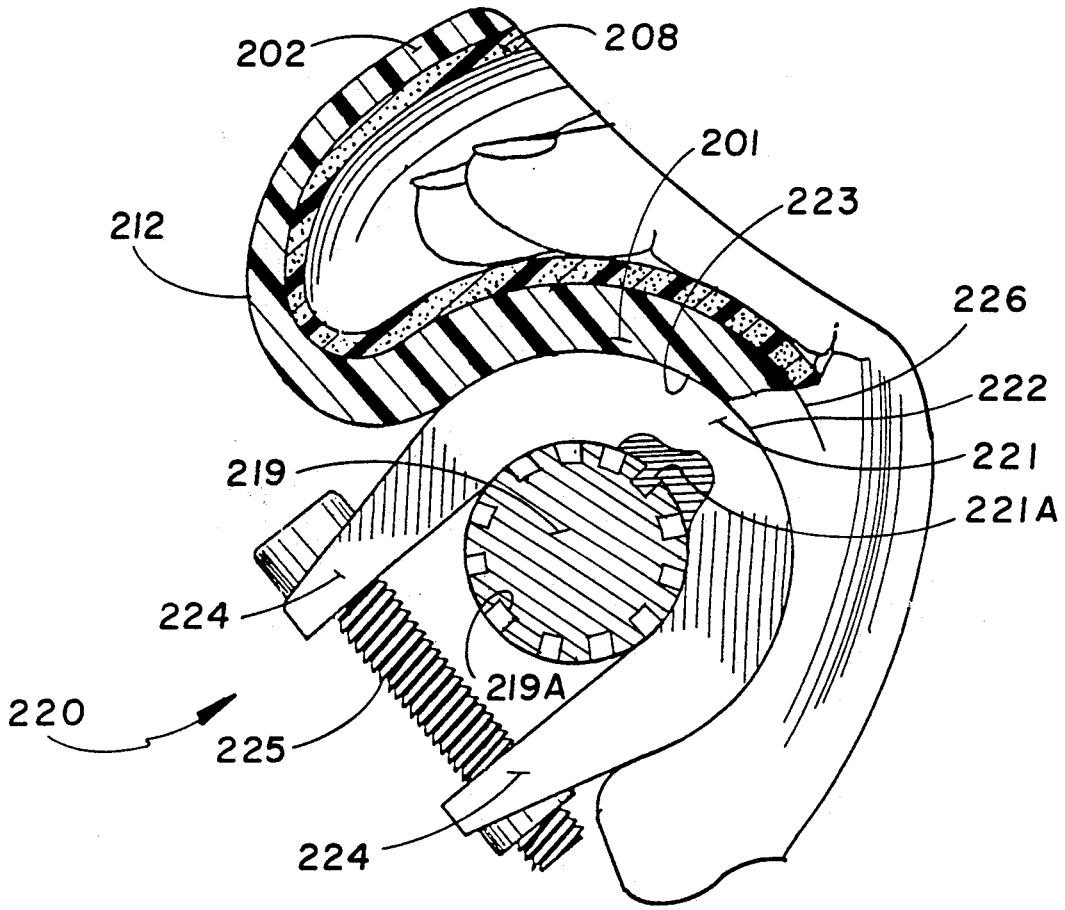
FIG. 43A is a portion of FIG. 42, showing how the handle may be attached to an existing handle, using a longitudinal key on the handle and cooperating with one of a plurality of circumferentially-spaced longitudinal keyways or splines on the handle (or on an adapter sleeve attached thereto) thereby facilitating easy interlocking and adjustment of the improved retrofit attachment handle of the present invention.

With reference to FIG. 43A, the C-clamp 221 may be provided with a longitudinal key 221A cooperating with a selected one of a plurality of circumferentially-spaced longitudinal splines or keyways 219A formed in the existing handle 219, thereby facilitating the selected circumferential indexing or adjustment of the retrofit handle 200 with respect to the existing handle 219, and thereby accommodating the needs of different uses on various apparatuses or devices and under various modes of operation thereof.

Figure 43B:
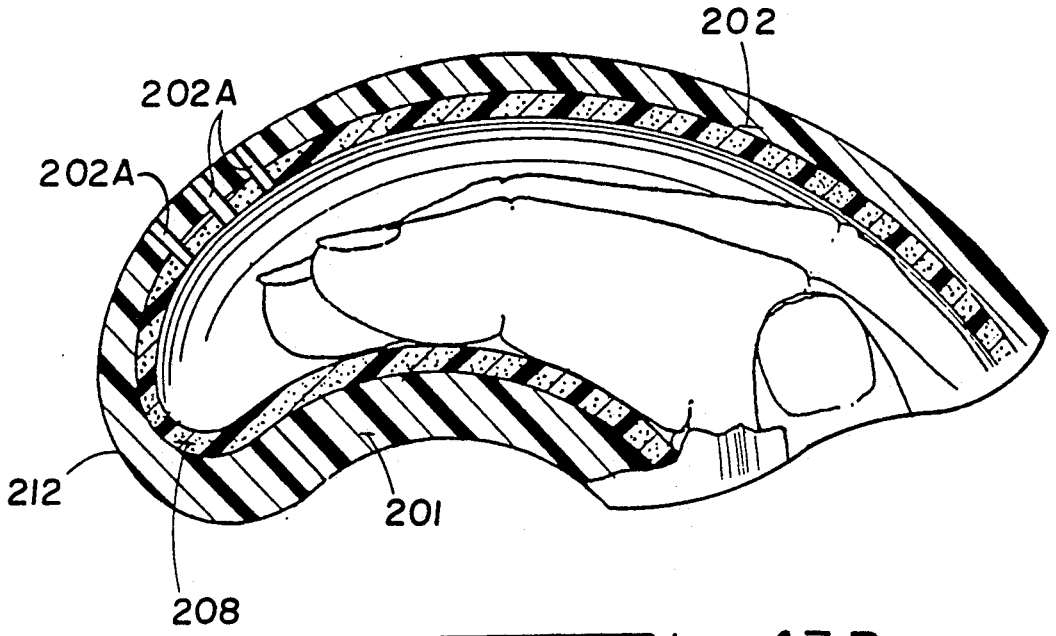
FIG. 43B is a further portion of FIG. 42, showing the use of ventilation openings within the handle, if desired.

With reference to FIG. 43B, the outer wall 202 of the handle 200 may be provided with a plurality of ventilation openings 202A formed therein, thereby alleviating any build-up of heat within the chamber 203 in the use of the handle 200 of the present invention in certain circumstances.

Preferably, the convex inner surface 206 of the inner wall 201 is formed on an arc 226 (see FIG. 43A) the center of which is substantially coincident with the longitudinal center 227 of the existing handle 219. On the other hand, the convex outer surface 211 of the outer wall 202 is formed on an arc 228 (see FIG. 43) which is eccentrically disposed with respect to the longitudinal center 227 of the existing handle 219.

Thus it will be appreciated that the improved handle 200 of the present invention—whether provided as a retrofit attachment for the existing handle of an apparatus or else integrally formed or mounted therewith—enables the user of the associated apparatus, device or equipment to control and manipulate the apparatus, device or equipment in a convenient and facile manner, requiring less force. A tight or forceful grip is not required, thereby substantially reducing the fatigue normally associated with the operation of the apparatus, device or equipment.

Application Of The Improved Handles To Exercise Devices, Equipment And Machines With reference to FIGS. 46–59, there is illustrated (pictorially and schematically) a variety of devices, equipment and machines intended for exercise, gymnastics and related body building purposes, with which the teachings and benefits of the present invention may find particular utility.

Figure 46:
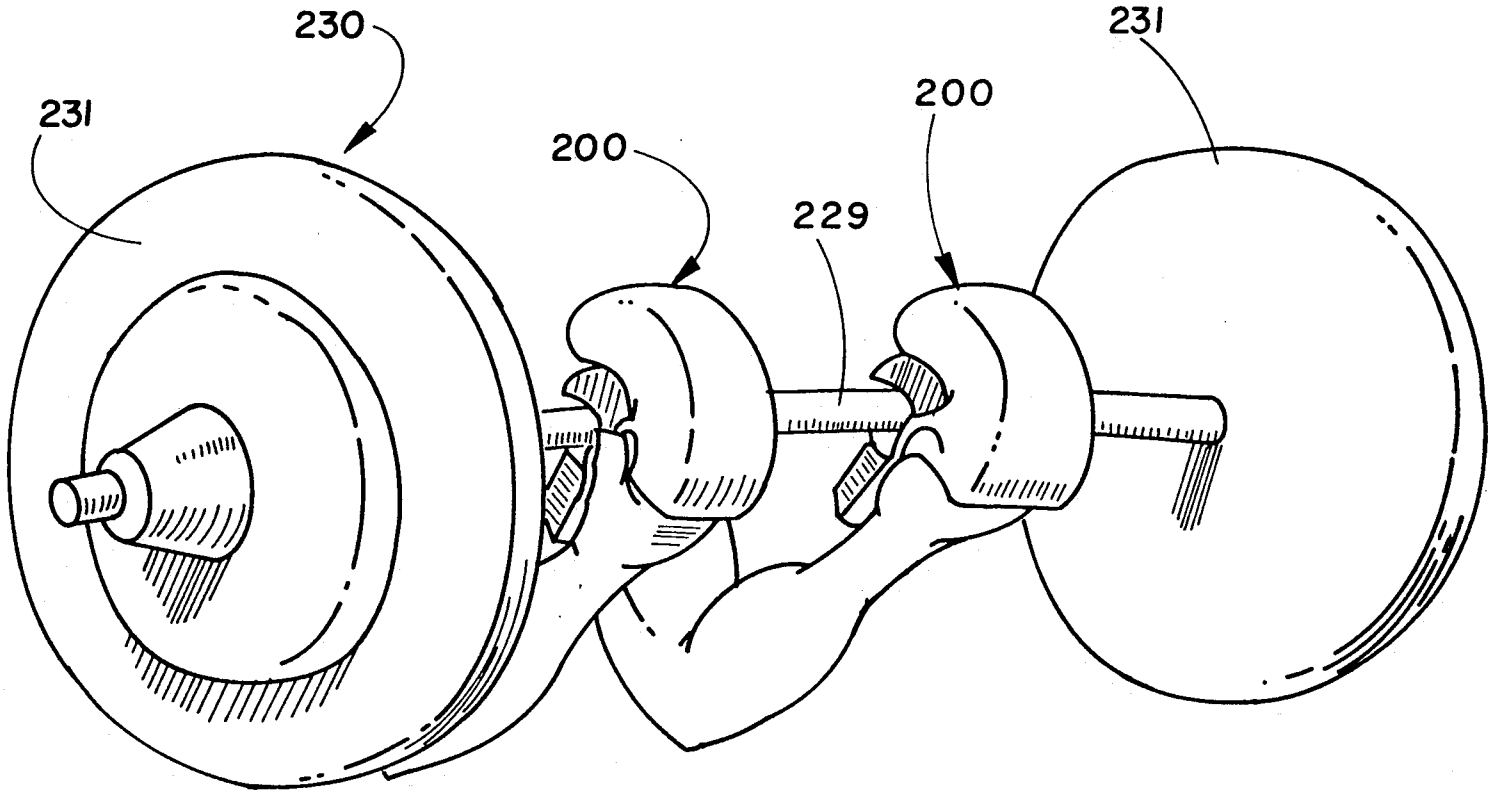
FIG. 46 is a perspective view, showing how a pair of handles (as shown in FIGS. 41–43) may be removably secured to a conventional barbell.

Thus, in FIG. 46, a pair of the handles 200 of the present invention are removably secured to the shank 229 of a conventional barbell 230 having weights 231 at the extremities thereof.

Figure 48:
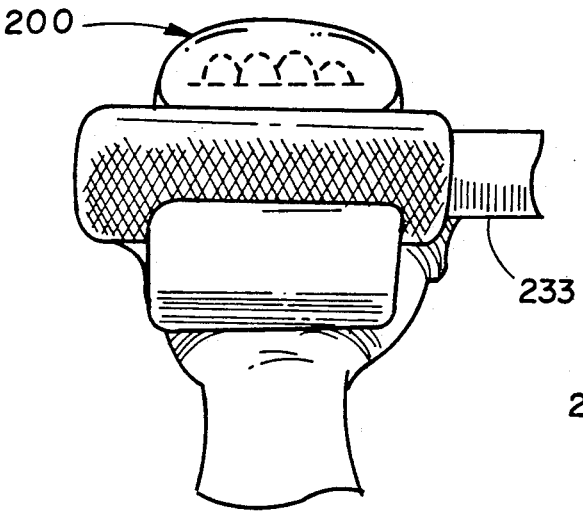
FIG. 48 is a pictorial view, taken along the lines 48—48 of FIG. 47 and drawn to an enlarged scale, and showing how the device of the present invention would be used when the barbell of FIG. 47 is being raised by the user.
Figure 49:
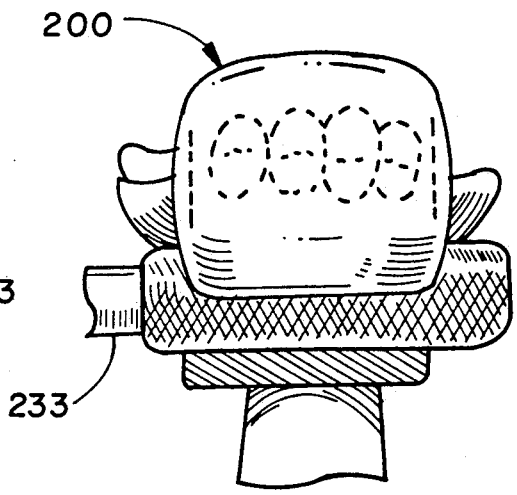
FIG. 49 is a further pictorial view, taken along the lines 49—49 of FIG. 47 and drawn to an enlarged scale, and showing how the device of the present invention would be used when the barbell of FIG. 47 is being lowered by the user.
Figure 47:
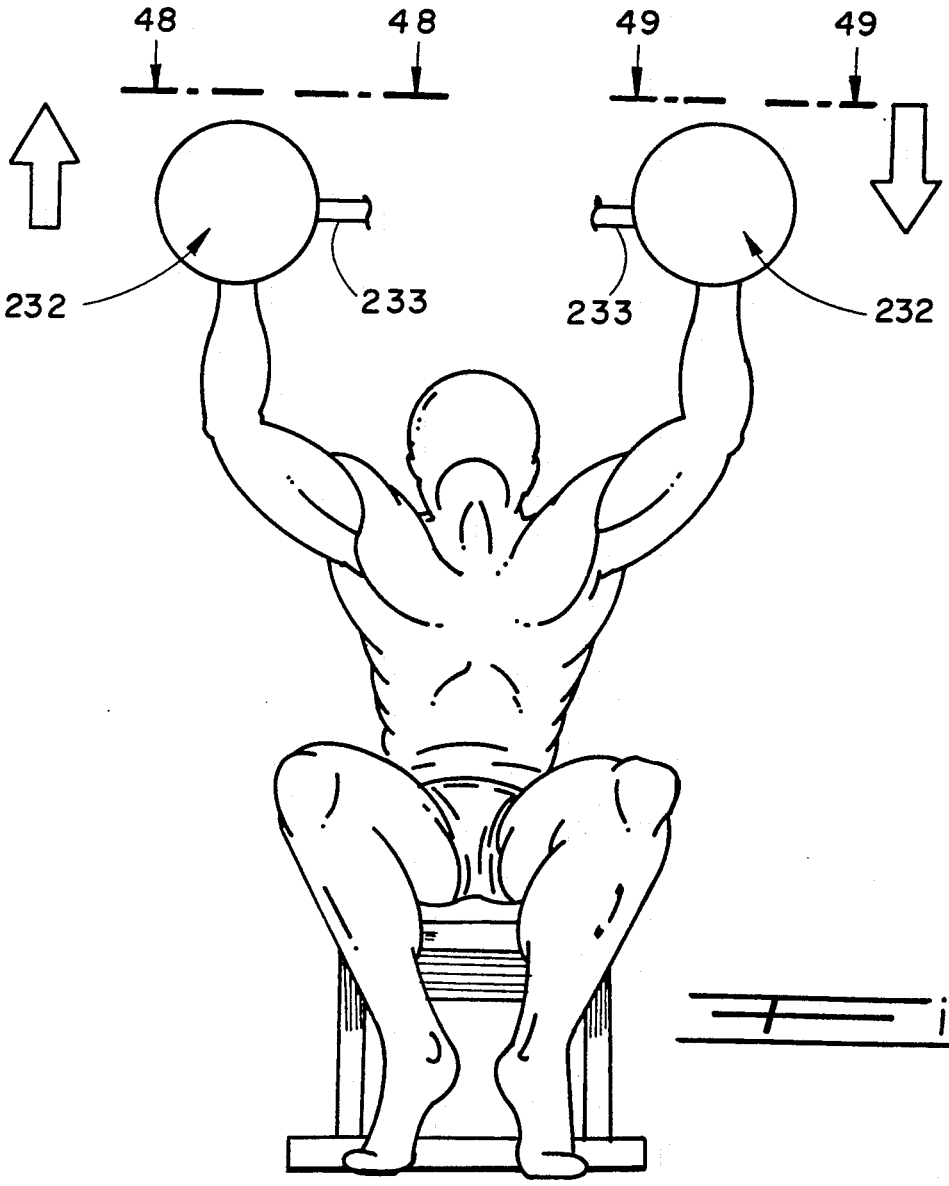
FIG. 47 shows how the exercise devices of the present invention may be used to form a barbell.

In FIGS. 47–49, the handles 200 are integrally formed within respective weighted exercise devices 232 mounted on opposite ends of a shank 233.

Figure 51:
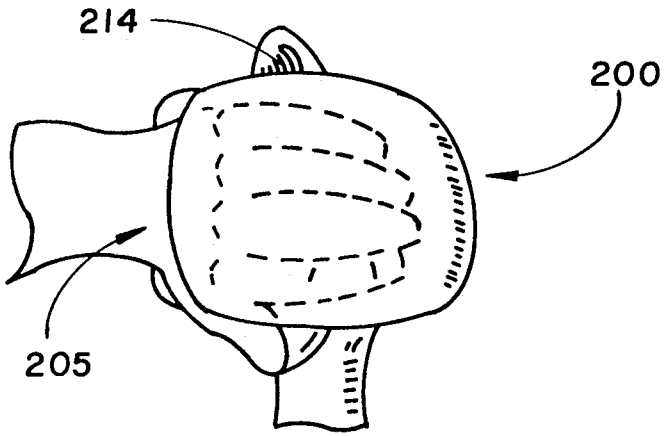
FIG. 51 shows how the user's left hand would be positioned within the improved handle of the present invention, when using the exercise machine of FIG. 50.
Figure 52:
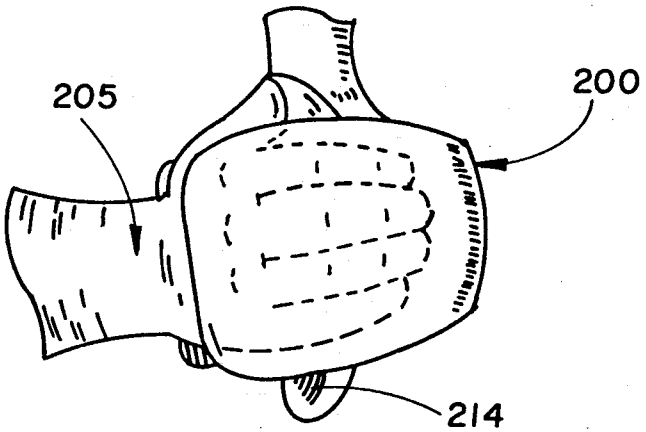
FIG. 52 shows how the user's right hand would be positioned within the improved handle of the present invention, when using the exercise machine of FIG. 50.
Figure 50:
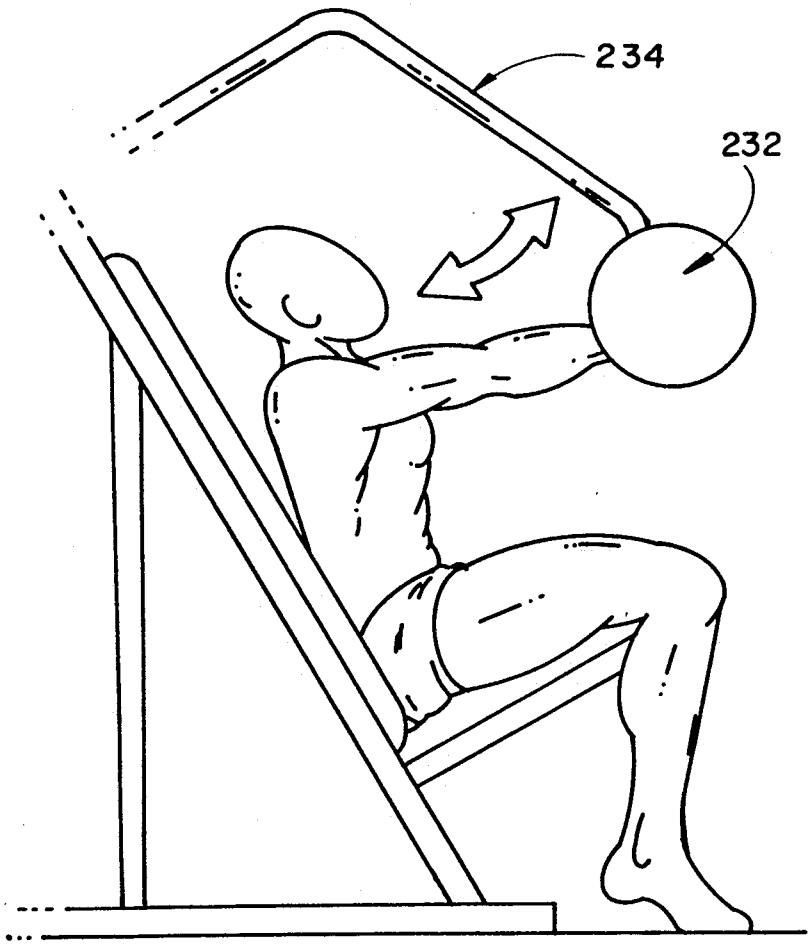
FIG. 50 is a side elevational view, showing how the improved handles of the present invention may be applied to the hand grips of a typical stationary exercise machine, the latter being shown schematically for ease of illustration.

In FIGS. 50–52, the handles 200 are part of a stationary exercise machine 234 (shown schematically).

Figure 53:
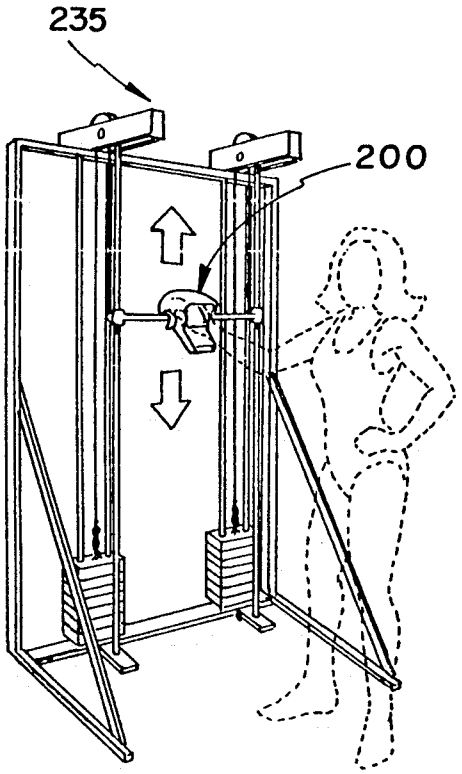
FIG. 53 is a perspective view of a conventional exercise machine, showing how the teachings of the present invention are applied thereto.

FIG. 53 shows the handle 200 of the present invention on a stationary exercise machine 235 known in the industry as a cable pulley machine.

Figure 54:
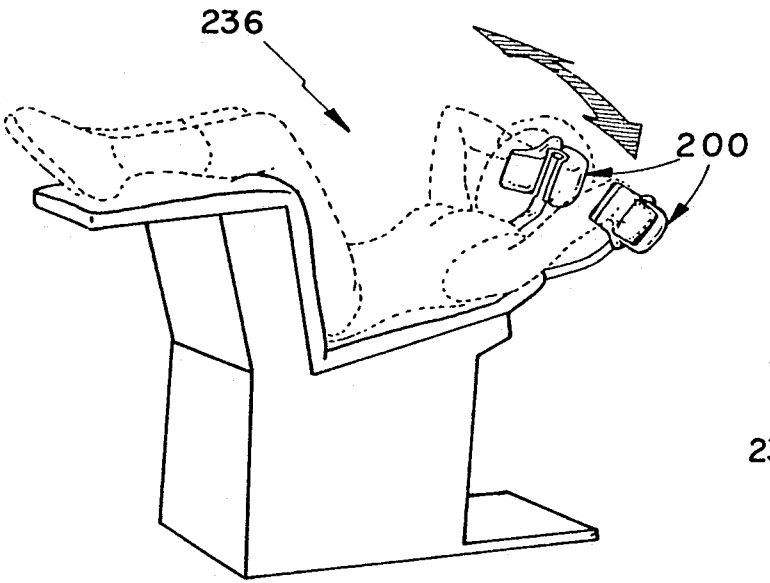
FIG. 54 is a perspective view of a further conventional exercise machine, showing how the teachings of the present invention are applied thereto.

FIG. 54 shows the handle 200 of the present invention on another stationary exercise machine 236, known in the industry as an abdominal trunk curl.

Figure 55:
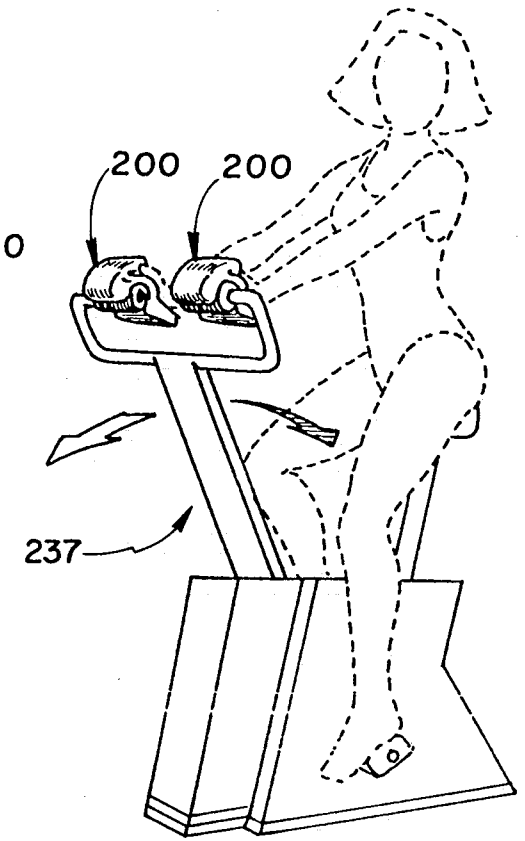
FIG. 55 is a perspective view of a still further conventional exercise machine, constituting a stationary bicycle, showing how the teachings of the present invention are applied thereto.

FIG. 55 shows the handles 200 of the present invention on yet another stationary exercise machine 237, constituting a stationary exercise bicycle.

Figure 56:
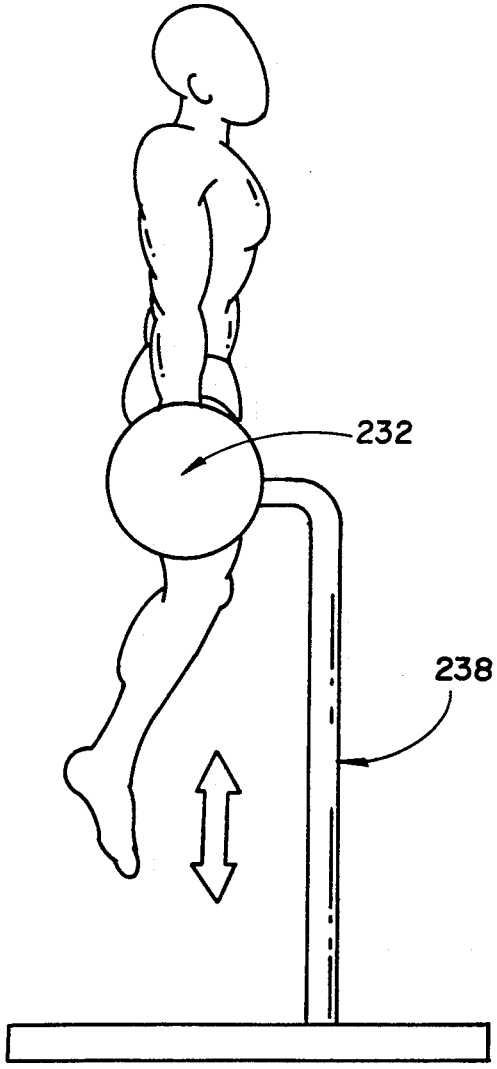
FIG. 56 is a side elevation of a stationary bar (shown schematically) having a pair of handles and on which exercises or gymnastics may be performed, showing how the improved handles of the present invention may be applied thereto.
Figure 57:
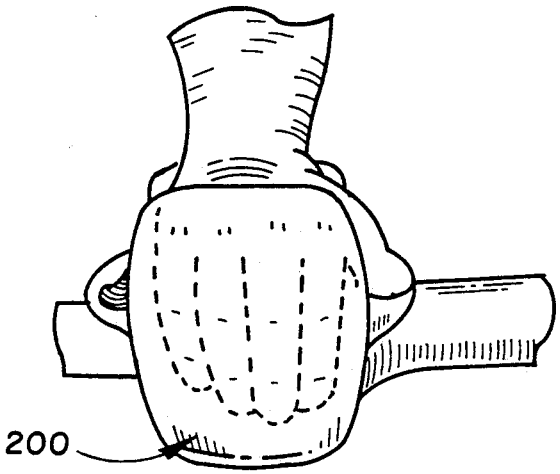
FIG. 57 is an enlarged top plan view of a portion of FIG. 56, showing the user's right hand positioned within the improved handle.
Figure 58:
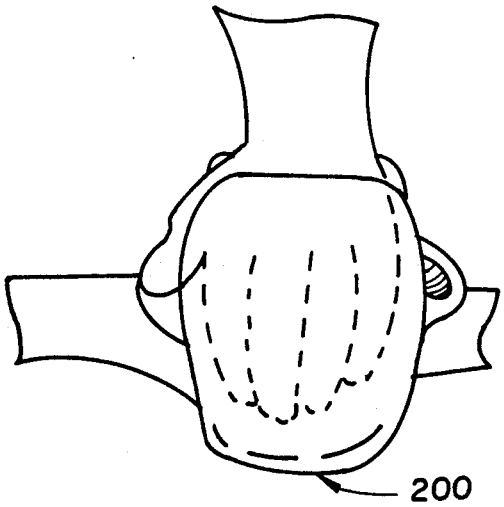
FIG. 58 is an enlarged top plan view of a portion of FIG. 54, corresponding to FIG. 56, but showing the user's left hand positioned within the improved handle.

FIGS. 56–58 show the handles 200 of the present invention applied to a stationary horizontal bar 238 (shown schematically) on which various exercises or gymnastics may be performed, such as "dips".

Figure 59:
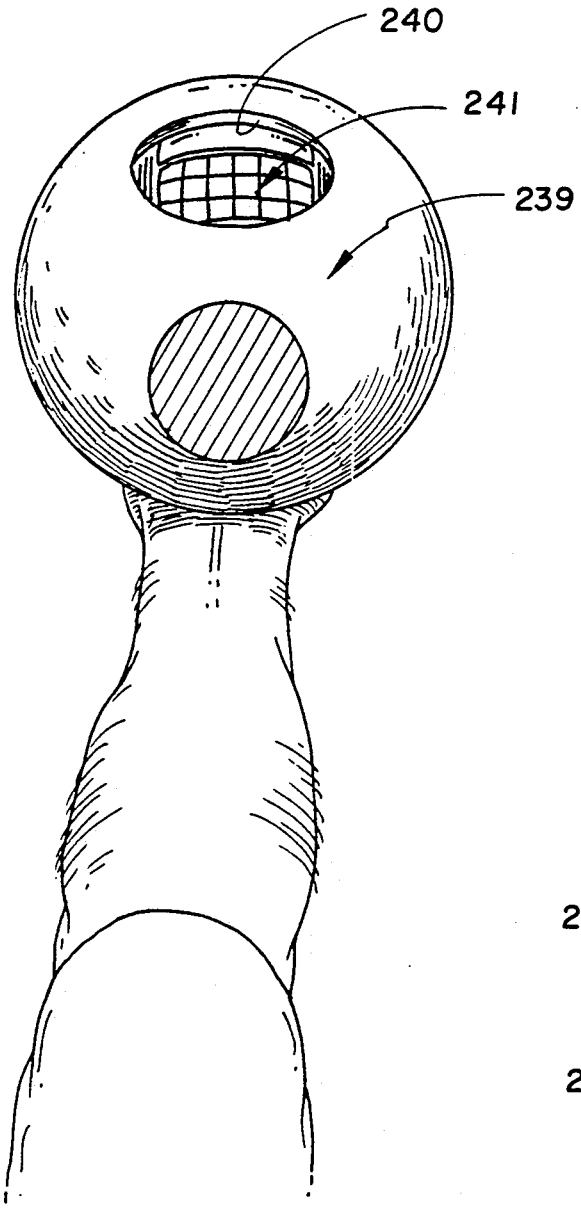
FIG. 59 is a pictorial view of the exercise device of the present invention (such as that shown in FIG. 2) showing how the device has an aperture formed therein for external viewing of a digital display, the display being connected to a microprocessor with associated memory contained within the exercise device itself.

In FIG. 59, a weighted exercise device 239, within which the handle 200 of the present invention is integrally fashioned, is provided with an opening 240 for externally viewing a screen or display 241 within the exercise device 239. The screen or display 241, which may be digital or analog or both, is connected to a programmed microprocessor (not shown) within the exercise device 239 and having a memory associated therewith, thereby providing the user with a convenient read-out of the amount of exercises performed with the device 239. Moreover, with the proper pick-up devices on the user's wrist (or other parts of the body) a read-out of the user's blood pressure, pulse rate or other body parameters may be displayed on the screen 241. A voice-responsive mechanism may also be employed, if desired, to alert the user.

Figure 60:
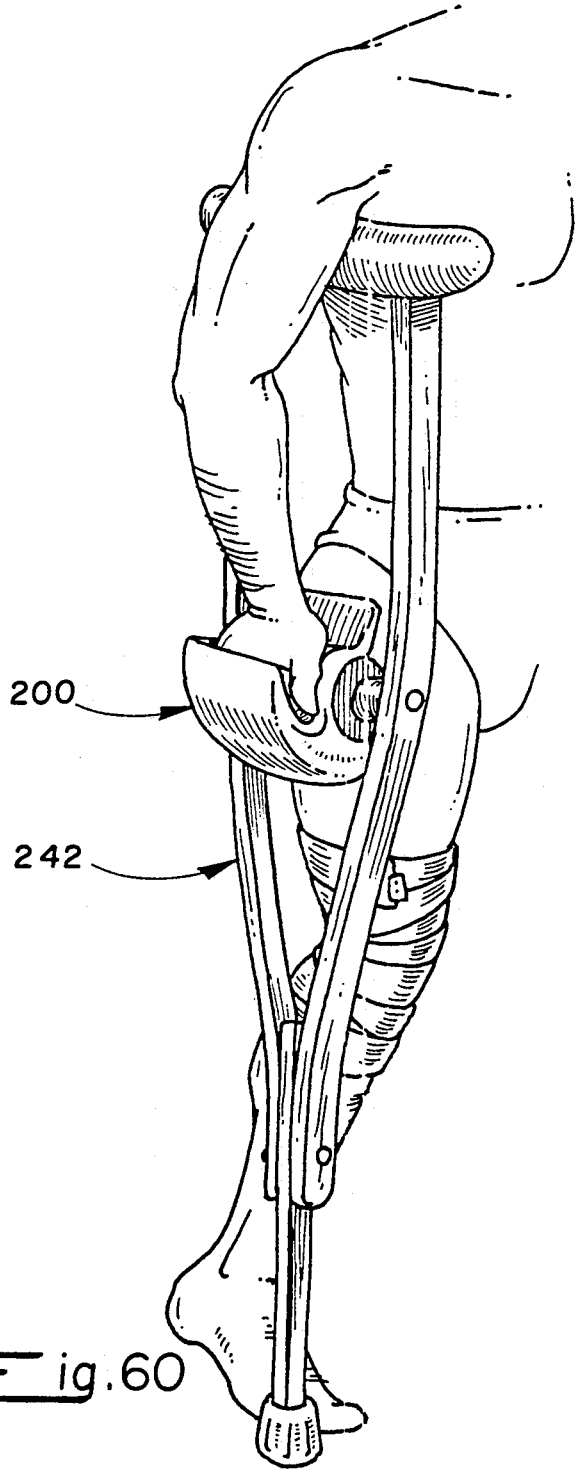
FIG. 60 is a pictorial view showing how the improved handle of the present invention may be applied to a device for assisting handicapped or temporarily disabled persons, the device in FIG. 58 constituting a crutch (for example).

Application Of The Improved Handles To Devices For Handicapped Or Temporarily Disabled Persons In FIG. 60, the handle 200 of the present invention has been applied to a crutch 242 to enable a handicapped or temporarily disabled person to use the crutch more comfortably and conveniently. The crutch 242 is representative of a wide variety of devices for handicapped or temporarily disabled persons, with which the teachings of the present invention may find particular utility.

Application Of The Improved Handles To Power Tools

Figure 61:
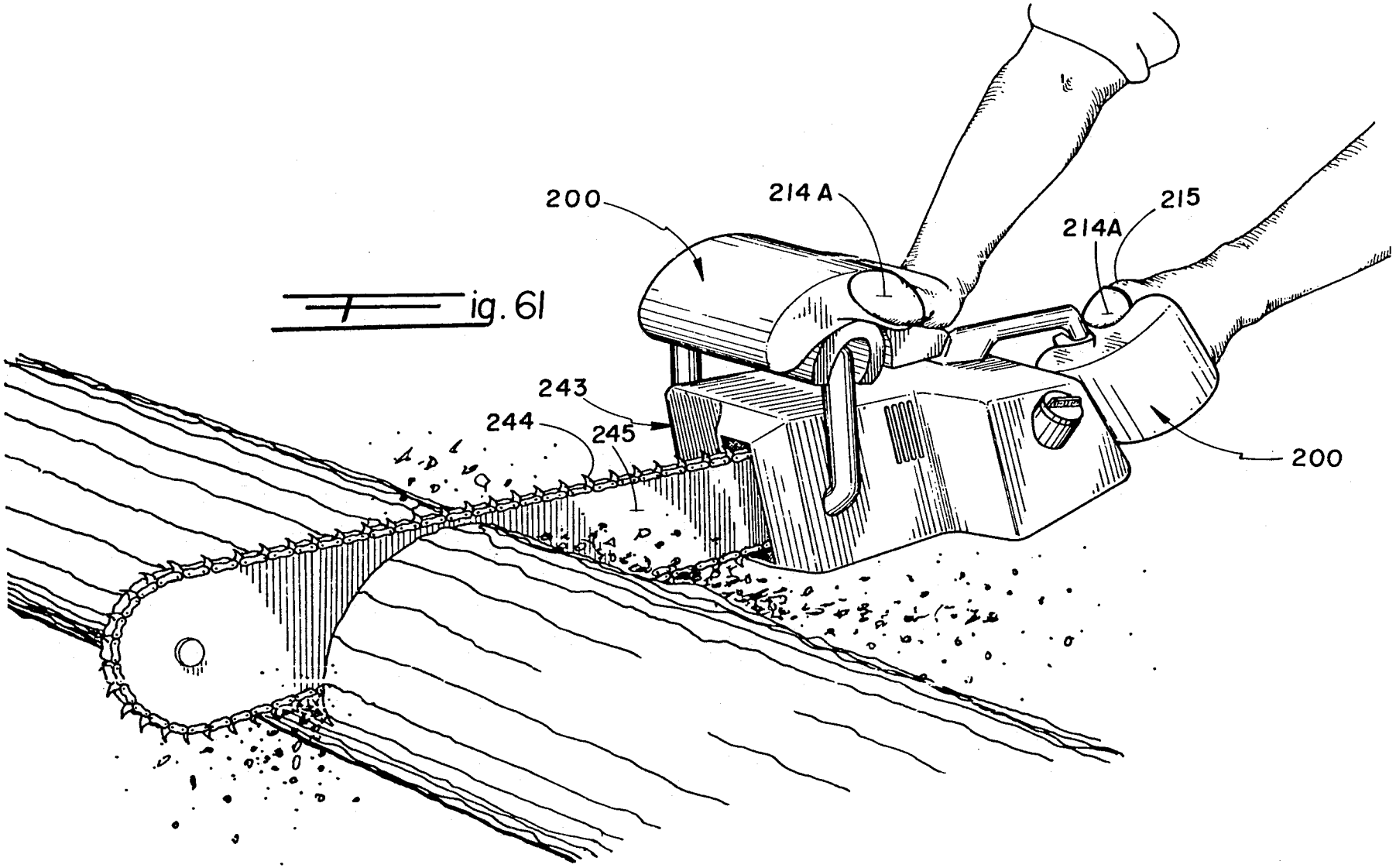
FIG. 61 is a pictorial view of a typical power tool, in this case a chain saw, showing the improved handles of the present invention applied thereto, and further showing respective shrouds over the indentations, thereby providing improved safety as well as comfort and convenience in using the chain saw.

In FIG. 61, the handles 200 of the present invention are applied, respectively, to the overhead bail handle and the rearward end handle of a chain saw 243 having a driven saw chain 244 mounted on a bar 245 projecting forwardly of the chain saw 243.

In FIG. 61, the indentations 214 for the user's thumb 215 have been provided with shrouds 214A for further safety reasons. Thus a pair of shrouds 214A have been provided, one on each side of the handle 200, and substantially 180° opposed.

The handles 200 contribute substantially to the ease and comfort of operating the chain saw 243, and maintaining control thereof, while also providing an enhanced safety feature for the operator's hands in the event of "kick back" of the chain saw 243.

The chain saw 243 is thus indicative of the wide variety of portable power tools and appliances (driven electrically, pneumatically or hydraulically) with which the teachings of the present invention may find particular utility.

Application Of The Improved Handles To Hand Tools

Figure 62:
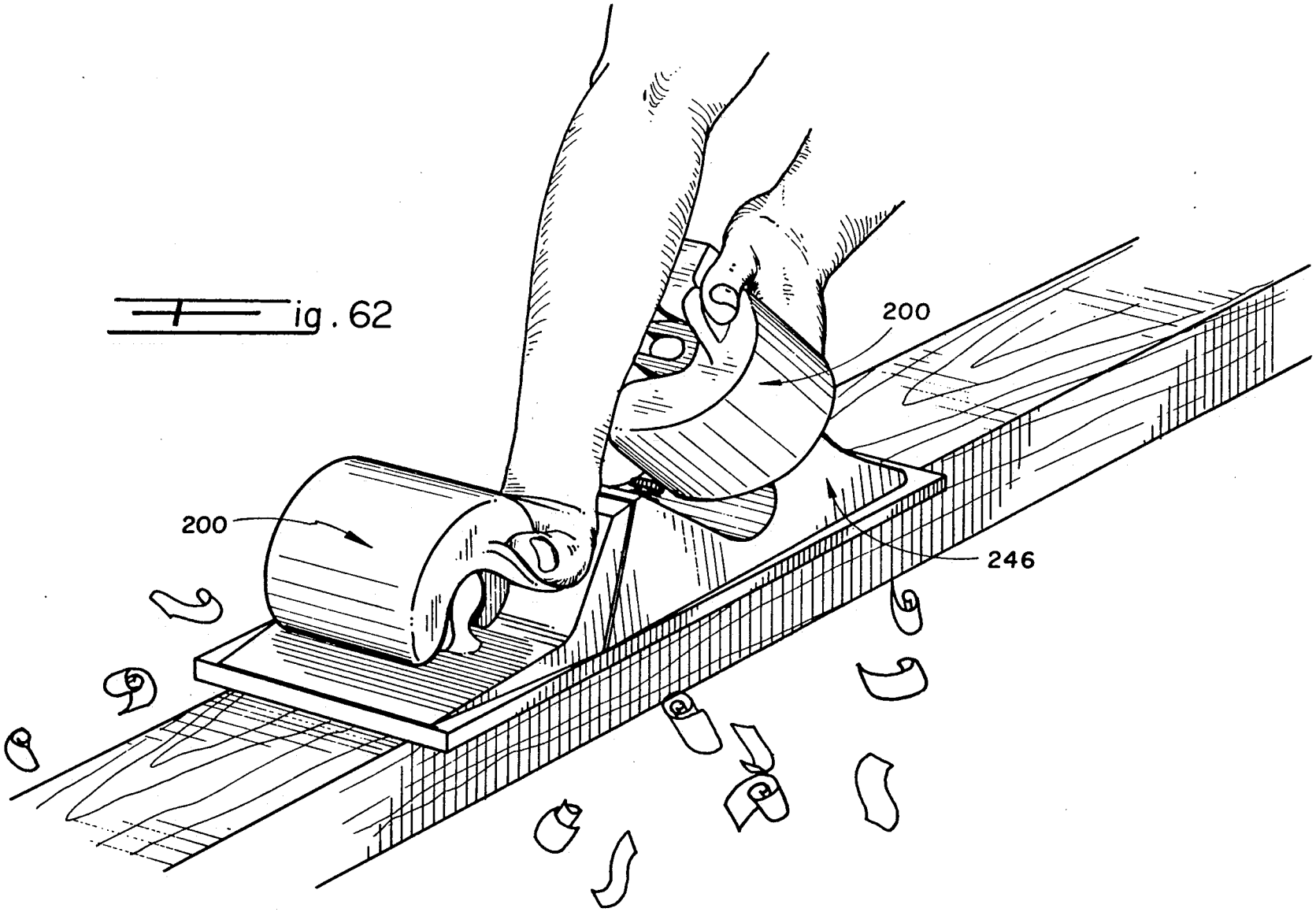
FIG. 62 is a pictorial view of a typical hand tool, in this case a hand pane, showing the improved handles of the present invention applied thereto.

In FIG. 62, the handles 200 of the present invention have been applied to the forward and rearward handles, respectively, of a hand plane 246. The hand plane 246 of FIG. 60 is shown being used by a left-handed person. However, the rearward handle 200 may be easily removed, if desired, and replaced with a suitable handle (or "flipped over") for use by a right-handed person. The forward handle 200 (as previously noted) is ambidextrous. Thus the forward handle 200 can be integral and the rearward handle 200 made replaceable. The hand plane 246 is indicative of a wide variety of hand tools and implements, with which the teachings of the present invention may find particular utility.

Application Of The Improved Handles To Stationary Power Tools

Figure 63:
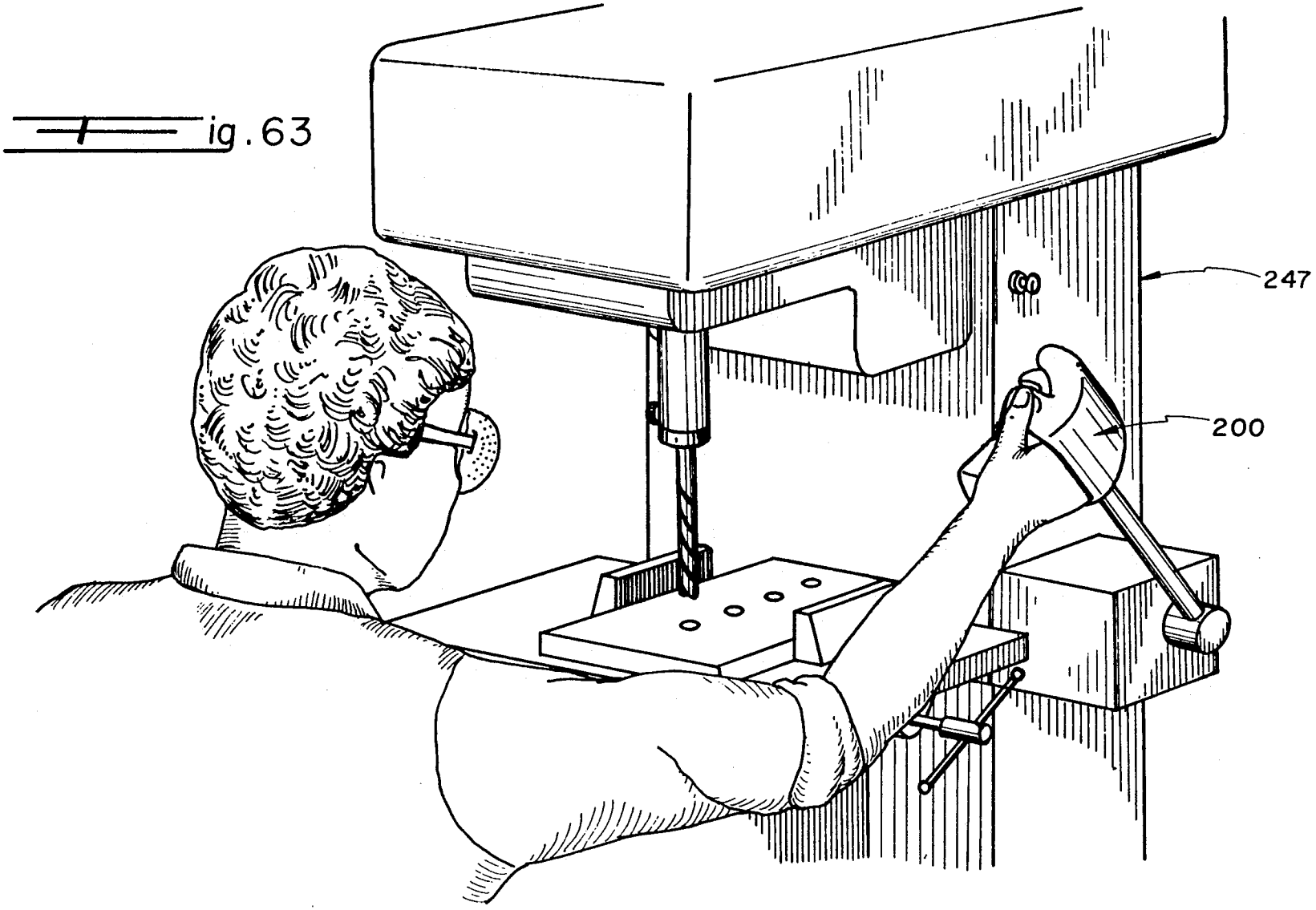
FIG. 63 is a pictorial view of a typical stationary power tool, in this case a drill press, showing the improved handle of the present invention applied thereto.

In FIG. 63, the handle 200 of the present invention has been applied to a drill press 247, which is indicative of the wide variety of stationary power tools, machines and equipment with which the teachings of the present invention may find particular utility.

Application Of The Improved Handles To Earth-Moving Equipment

Figure 64:
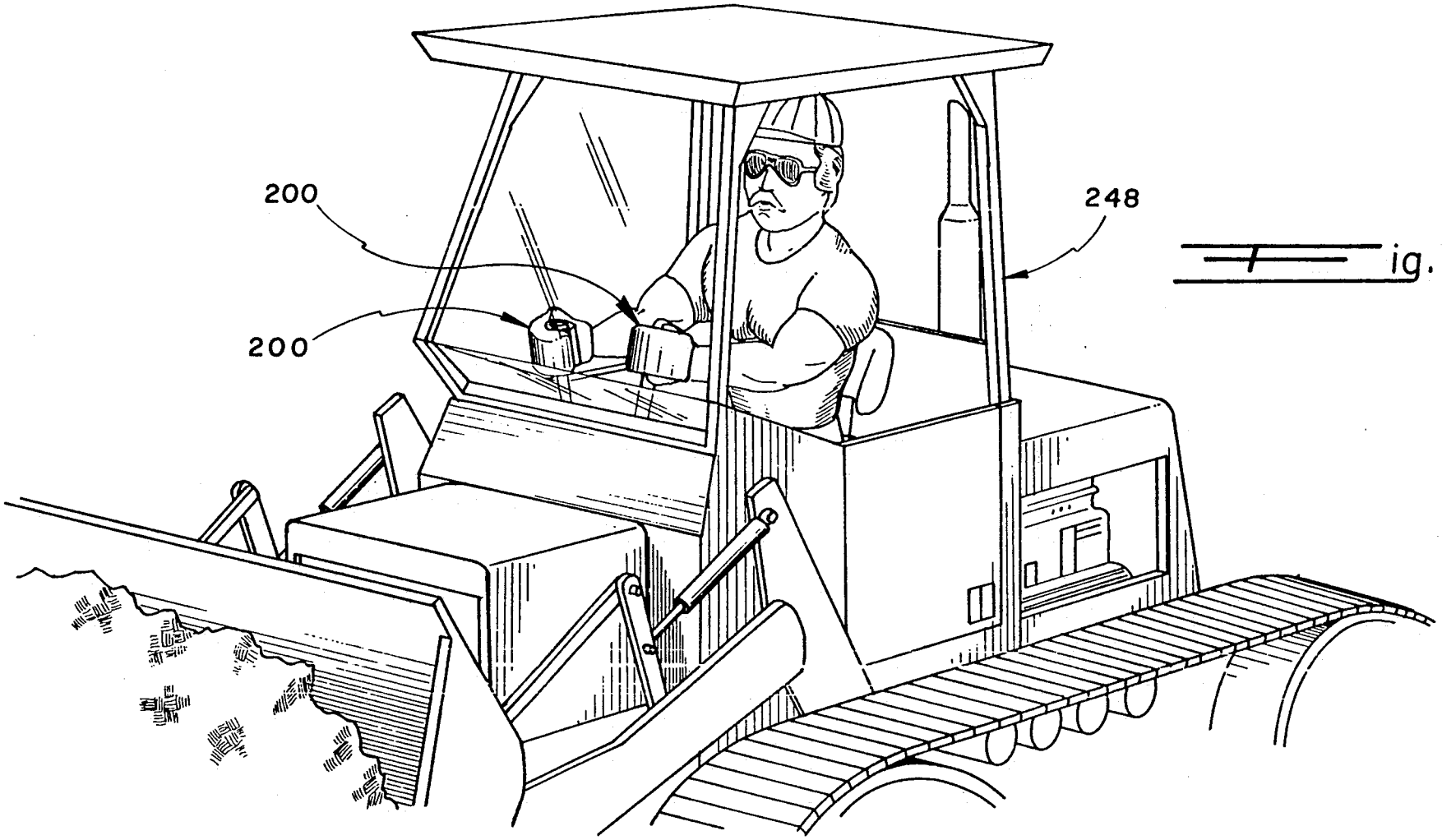
FIG. 64 is a pictorial view of a typical piece of earth-moving equipment, in this case a bulldozer, showing the improved handles of the present invention applied thereto.

In FIG. 64, the handles 200 of the present invention have been applied to a piece of earth-moving equipment, in this case a bulldozer 248, which is indicative of the wide variety of tractors, off-the-road machines and other pieces of heavy equipment, with which the teachings of the present invention may find particular utility.

If desired, heating elements may be disposed within the handle 200 for outdoor usage during inclement weather; the heating elements may be controlled by an off/-switch (not shown) and may be powered by a battery or solar energy or by the electrical power supply within the equipment itself.

Application Of The Improved Handles To Motorcycles

Figure 65:
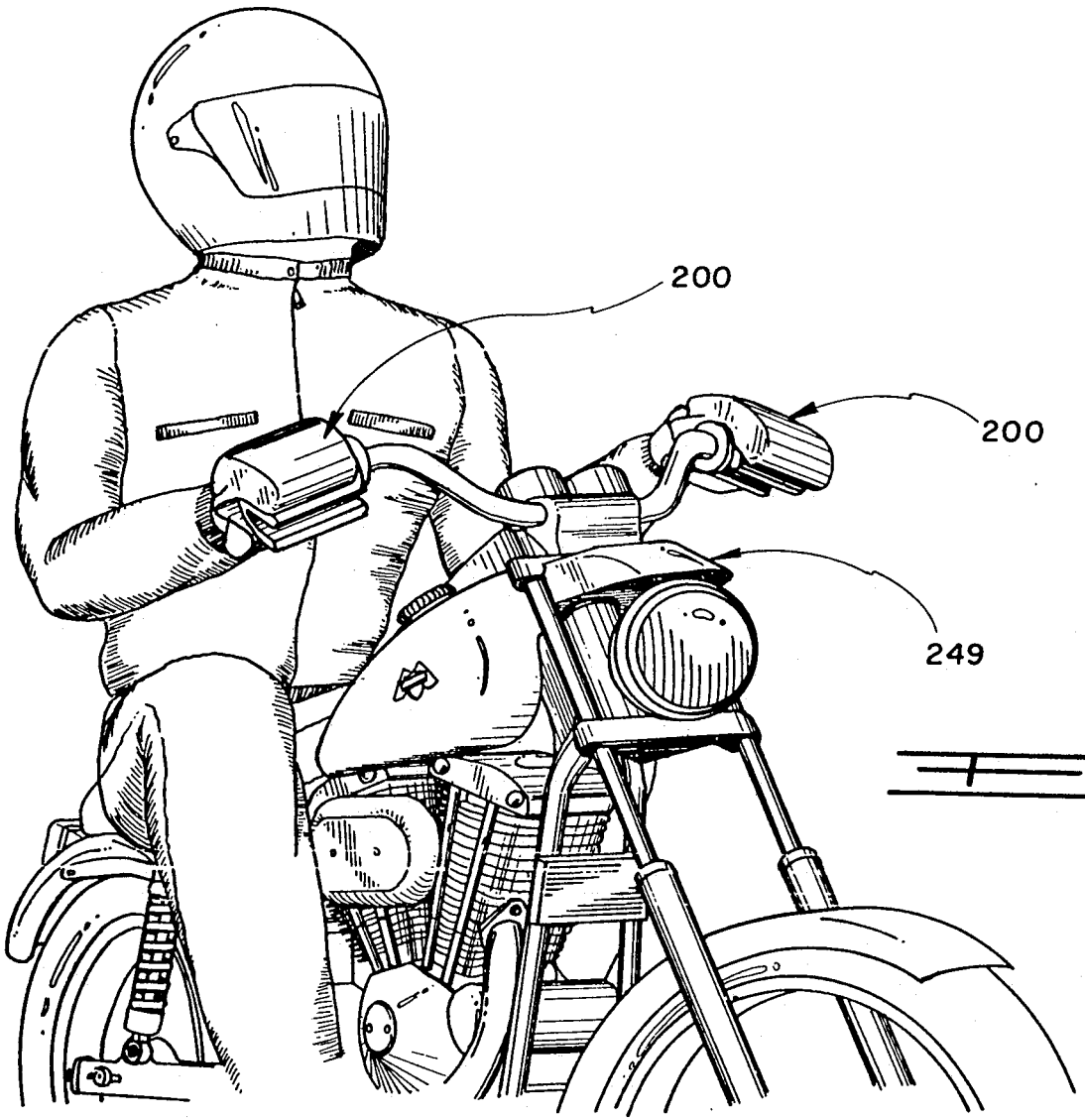
FIG. 65 is a pictorial view of a motorcycle, showing the improved handles of the present invention applied thereto.

In FIG. 65, the handles 200 of the present invention have been applied to the conventional hand grips of a motorcycle 249. The motorcycle 249 is indicative of the wide variety of bicycles, snowmobiles or other forms of transportation, with which the present invention may find particular utility. In the motorcycle application, it will be appreciated that suitable sensors (not shown) would be provided with the handle 200 for control of the motorcycle 249.

Improved Handles With Sensors And Microprocessor Controls

Figure 66:
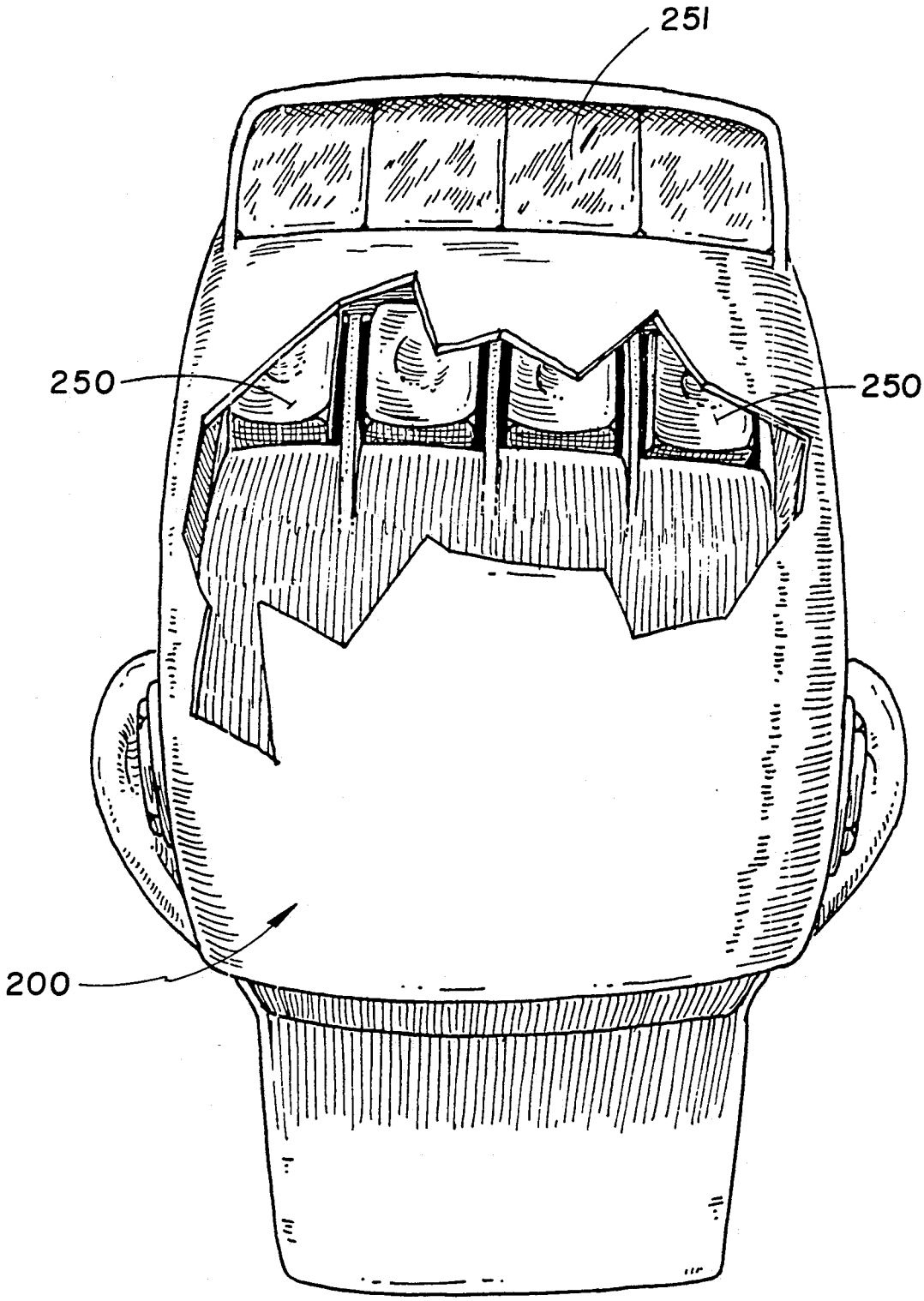
FIG. 66 is a top plan view of an improved handle of the present invention, with parts broken away to illustrate a plurality of finger-tip sensors together with a visual display.

In FIG. 66, there is illustrated an improved handle 200 of the present invention which is equipped with finger-tip sensors 250 which are inputted to a microprocessor or microcomputer means having an associated memory (not shown) and a visual display 251. This embodiment of the invention could be useful in a variety of applications, such as in the motorcycle 249.

Advantages, Benefits And Features Of The Improved Handles Of The Present Invention With the handles of the present invention, the user's hand is in substantially a curved natural "at rest" position, rather than being tightly closed. Thus a forceful grip is not required, as is the case with the conventional handles or hand grips habitually resorted to in the prior art. Using the improved handles of the present invention, it is much easier and more comfortable and convenient to use, operate and control the particular apparatus, equipment or device associated with the handle. The human effort and energy required for manipulation or control of the apparatus, equipment or device is substantially reduced, thereby substantially reducing the fatigue normally associated therewith. Additionally, and in certain applications, the safety considerations are substantially enhanced. Finger-tip sensors and analog/-digital read-outs are also available. The handles may be employed either integrally or as retrofit attachments, and the handles are equally applicable to a wide variety of apparatuses used in industry, commerce, in the home, or for exercise and recreational purposes.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with an apparatus having an existing handle, an auxiliary handle for the apparatus and means to detachably attach the auxiliary handle to the existing handle of the apparatus; such that when attached, the auxiliary handle is rigidly secured to the existing handle and is disposed radially outwardly of the existing handle, wherein a forceful grip is not required for the manipulation or control of the apparatus, the auxiliary handle being substantially unitary and rigid and having respective inner and outer walls defining a chamber therebetween, the auxiliary handle having an opening formed therein and communicating with the chamber for providing access for the user's hand, the chamber being closed internally of the auxiliary handle and limiting the degree of insertion of the user's hand through the opening and into the chamber, such that the user's hand is disposed in the chamber between the inner and outer walls of the auxiliary handle, the inner wall having a substantially convex inner surface, and the outer wall having a substantially concave inner surface, such that the palm of the user's hand substantially rests on the convex inner surface of the inner wall, and such that the back of the user's hand substantially confronts the concave inner surface of the wall, so that the user's hand is substantially in a curved natural at rest position rather than being tightly closed, thereby substantially reducing the human effort and energy required to manipulate or control the apparatus, and thereby substantially reducing the fatigue normally associated therewith and the existing handle of the apparatus being disposed radially inwardly of the inner wall of the auxiliary handle and being nested therein, such that the weight concentration of the existing handle is aligned radially with respect to the auxiliary handle and the user's hand therein.

2. The combination of claim 1, wherein the outer wall further has a convex outer surface, wherein the inner and outer walls are joined together at an outer extremity of the handle, and wherein the chamber gradually narrows in height between the inner and outer walls of the handle in the direction from the opening in the handle to the outer extremity thereof.

3. The combination of claim 1, wherein the convex inner surface of the inner wall, and the concave inner surface of the outer wall, are each provided with a cushioned layer.

4. The combination of claim 3, wherein the cushioned layer is substantially continuous and has a substantially uniform cross-section.

5. The combination of claim 1, wherein the inner wall further has a continuation thereof extending past the opening in the handle and including a substantially concave portion, such that the heel of the user's hand adjacent to the palm thereof may rest against the concave portion of the continuation of the inner wall.

6. The combination of claim 1, wherein the outer wall has a plurality of ventilation openings formed therein.

7. The combination of claim 1, wherein the convex inner surface of the inner wall is formed on an arc, the center of which is substantially coincident with the longitudinal center of the exiting handle, and wherein the convex outer surface of the outer wall is formed on an arc which is eccentrically disposed with respect to the longitudinal center of the existing handle.

8. In combination with an apparatus, a handle for the apparatus, wherein the handle does not require a forceful grip for the manipulation or control of the apparatus, the handle being substantially unitary and having respective inner and outer walls defining a chamber therebetween, the handle having an opening formed therein and communicating with the chamber for providing access for the user's hand, such that the user's hand is disposed in the chamber between the inner and outer walls of the handle, the inner wall having a substantially convex inner surface, and the outer wall having a substantially concave inner surface, such that the palm of the user's hand substantially rests on a convex inner surface of the inner wall, and such that the back of the user's hand substantially confronts the concave inner surface of the outer wall, so that the user's hand is substantially in a curved natural at rest position rather than being tightly closed, thereby substantially reducing the human effort and energy required to manipulate or control the apparatus, and thereby substantially reducing the fatigue normally associated therewith, wherein the handle further has a pair of substantially parallel side walls joining the inner and outer walls, and wherein each of the side walls is provided with an indentation, such that the user's thumb may rest in an indentation of a respective side wall, and such that the pair of indentations in the respective side walls facilitate use of the handle by either right-handed or left-handed persons.

9. The combination of claim 8, further including a shroud on the handle and substantially covering each indentation.

10. In combination with an apparatus, a handle for the apparatus, wherein the handle does not require a forceful grip for the manipulation or control of the apparatus, the handle being substantially unitary and having respective inner and outer walls defining a chamber therebetween, the handle having an opening formed therein and communicating with the chamber for providing access for the user's hand, such that the user's hand is disposed in the chamber between the inner and outer walls of the handle, the inner wall having a convex inner surface and a concave outer surface, the outer wall having a concave inner surface and a convex outer surface, such that the palm of the user's hand substantially rests on the convex inner surface of the inner wall, and such that the back of the user's hand substantially confronts the concave inner surface of the outer wall, so that the user's hand is substantially in a curved natural at rest position rather than being tightly closed, thereby substantially reducing the human effort and energy required to manipulate or control the apparatus, and thereby substantially reducing the fatigue normally associated therewith, the inner and outer walls joining together at an outer extremity of the handle, the chamber gradually narrowing in height between the inner and outer walls of the handle in the direction from the opening in the handle to the outer extremity thereof, a cushioned layer on the convex inner surface of the inner wall and the concave inner surface of the outer wall, the handle further having a pair of substantially parallel side walls joining the inner and outer walls, each of the side walls being provided with an indentation, such that the user's thumb may rest in an indentation of a respective side wall, and such that the pair of indentations in the respective side walls facilitate use of the handle by either right-handed or left-handed persons, and the inner wall further having a continuation thereof extending past the opening in the handle and including a substantially concave portion, such that the heel of the user's hand adjacent to the palm thereof may rest against the concave portion of the continuation of the inner wall.

11. In combination with an apparatus having an existing handle, a handle for the apparatus, wherein the handle does not require a forceful grip for the manipulation or control of the apparatus, the handle being substantially unitary and having respective inner and outer walls defining a chamber therebetween, the handle having an opening formed therein and communicating with the chamber for providing access for the user's hand, such that the user's hand is disposed in the chamber between the inner and outer walls of the handle, the inner wall having a substantially convex inner surface, and the outer wall having a substantially concave inner surface, such that the palm of the user's hand substantially rests on the convex inner surface of the inner wall, and such that the back of the user's hand substantially confronts the concave inner surface of the outer wall, so that the user's hand is substantially in a curved natural at rest position rather than being tightly closed, thereby substantially reducing the human effort and energy required to manipulate or control the apparatus, and thereby substantially reducing the fatigue normally associated therewith, wherein the handle comprises an attachment to the existing handle of the apparatus, and wherein means are provided for removably securing the attachment to the existing handle of the apparatus and, wherein the means for removably securing the attachment to the existing handle of the apparatus comprises a C-clamp secured to the inner wall of the attachment and projecting away from the attachment, the C-clamp having a convex surface which is substantially nested within the concave inner surface of the inner wall of the attachment, the C-clamp having a pair of legs straddling the handle of the apparatus, and means for tightening the legs of the C-clamp on to the handle.

12. In combination with an apparatus having an existing handle, a handle for the apparatus, wherein the handle does not require a forceful grip for the manipulation or control of the apparatus, the handle being substantially unitary and having respective inner and outer walls defining a chamber therebetween, the handle having an opening formed therein and communicating with the chamber for providing access for the user's hand, such that the user's hand is disposed in the chamber between the inner and outer walls of the handle, the inner wall having a substantially convex inner surface, and the outer wall having a substantially concave inner surface, such that the palm of the user's hand substantially rests on the convex inner surface of the inner wall, and such that the back of the user's hand substantially confronts the concave inner surface of the outer wall, so that the user's hand is substantially in a curved natural at rest position rather than being tightly closed, thereby substantially reducing the human effort and energy required to manipulate or control the apparatus, and thereby substantially reducing the fatigue normally associated therewith, wherein the handle comprises attachment to the existing handle of the apparatus, and wherein means are provided for removably securing the attachment to the existing handle of the apparatus and, further including a longitudinal key on the inner wall of the attachment, and the existing handle being provided with a plurality of circumferentially-spaced longitudinally-splined keyways for cooperation with the longitudinal key on the attachment, such that the attachment may be secured on the existing handle in a selected circumferentially-adjusted position.

13. In combination with an apparatus having an existing handle, an attachment for the handle which does not require a forceful grip for the manipulation or control of the attachment being substantially unitary and having respective inner and outer walls defining a chamber therebetween, the attachment having an opening formed therein and communication with the chamber for providing access for the user's hand, such that the user's hand is disposed in the chamber between the inner and outer walls of the attachment, the inner wall having a convex inner surface, and the outer wall having a concave inner surface, such that the palm of the user's hand substantially rests on the convex inner surface of the inner wall, and such that the back of the user's hand substantially confronts the concave inner surface of the outer wall, so that the user's hand is substantially in a curved natural at rest position rather than being tightly closed, thereby substantially reducing the human effort and energy required to manipulate or control the apparatus, and thereby means for removably securing the attachment to the existing handle of the apparatus, including a C-clamp secured to the inner wall of the attachment and projecting away from the attachment, the C-clamp having a convex surface which is substantially nested within the concave inner surface of the inner wall of the attachment, the C-clamp having a pair of lets straddling the existing handle of the apparatus, and means for tightening the legs of the C-clamp on to the handle; and the convex inner surface of the inner wall being formed on an arc, the center of which is substantially coincident with the longitudinal center of the existing handle, and the convex outer surface of the outer wall being formed on an arc which is eccentrically disposed with respect to the longitudinal center of the existing handle.

14. In combination with an apparatus employing an existing handle that normally requires a forceful grip for the manipulation or control of the apparatus, an attachment comprising an auxiliary handle which substantially eliminates the necessity for a forceful grip on the existing handle, the auxiliary handle being substantially unitary and rigid and having respective inner and outer walls defining a chamber therebetween, the auxiliary handle having an opening formed therein and communicating with the chamber for providing access for the user's hand, the chamber being closed internally of the auxiliary handle and limiting the degree of insertion of the user's hand through the opening and into the chamber, such that the user's hand is disposed in the chamber between the inner and outer walls of the auxiliary handle, the inner wall having a concave outer surface and further having a convex inner surface within the chamber, the outer wall having a concave inner surface within the chamber, the concave outer surface of the inner wall substantially engaging the handle, and means for securing the auxiliary handle to the existing handle, such that the palm of the user's hand substantially rests on the convex inner surface of the inner wall, and such that the back of the user's hand substantially confronts the concave inner surface of the outer wall, so that the user's hand is substantially in a curved natural at rest position rather than being tightly closed around the existing handle, thereby substantially reducing the human effort and energy required to manipulate or control the apparatus, thereby substantially reducing the fatigue normally associated therewith, and wherein the existing handle of the apparatus is cradled within the concave outer surface of the inner wall of the auxiliary handle radially inwardly thereof, such that the weight concentration of the existing handle is aligned radially with respect to the auxiliary handle and the user's hand therein.

15. The combination of claim 14, wherein the apparatus comprises a hand-held exercise device, and wherein a programmed microprocessor is disposed within the exercise device and has memory means associated therewith, and a display connected to the microprocessor and viewable externally of the exercise device.

16. The combination of claim 15, further including an audio output responsive to the microprocessor.

17. The combination of claim 14, wherein the apparatus comprises a stationary exercise machine.

18. The combination of claim 14 wherein the apparatus comprises a stationary horizontal bar on which exercises or gymnastics are performed.

* * * * *